US009016406B2

(12) United States Patent
Coleman et al.

(10) Patent No.: US 9,016,406 B2
(45) Date of Patent: Apr. 28, 2015

(54) CUTTING INSERTS FOR EARTH-BORING BITS

(75) Inventors: Heath C. Coleman, Union Grove, AL (US); Prakash K. Mirchandani, Houston, TX (US)

(73) Assignee: Kennametal Inc., Latrobe, PA (US)

( * ) Notice: Subject to any disclaimer, the term of this patent is extended or adjusted under 35 U.S.C. 154(b) by 337 days.

(21) Appl. No.: 13/598,744

(22) Filed: Aug. 30, 2012

(65) Prior Publication Data

US 2013/0075165 A1 Mar. 28, 2013

Related U.S. Application Data

(60) Provisional application No. 61/537,670, filed on Sep. 22, 2011.

(51) Int. Cl.
*C22C 29/08* (2006.01)
*E21B 10/56* (2006.01)
(Continued)

(52) U.S. Cl.
CPC ..... *C22C 29/08* (2013.01); *E21B 10/56* (2013.01); *C22C 29/005* (2013.01); *B22F 2005/001* (2013.01)

(58) Field of Classification Search
CPC ... E21B 10/52; E21B 10/56; E21B 2010/563; C22C 29/08; C22C 29/005; B22F 2005/001
USPC ..... 175/374, 425, 426; 428/698, 457, 627; 76/108.2, 108.1, 108.4, 115; 407/119; 408/144; 419/6
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |

(Continued)

FOREIGN PATENT DOCUMENTS

| | | |
|---|---|---|
| AU | 695583 | 2/1998 |
| CA | 1018474 A | 10/1977 |

(Continued)

OTHER PUBLICATIONS

US 4,966,627, 10/1990, Keshavan et al. (withdrawn).

(Continued)

*Primary Examiner* — Daniel P Stephenson
(74) *Attorney, Agent, or Firm* — Matthew W. Smith

(57) ABSTRACT

A cutting insert for an earth-boring bit comprises a cemented carbide material. The cemented carbide material comprises a plurality of tungsten carbide grains, and a plurality of cubic carbide grains comprising at least one of titanium carbide, vanadium carbide, zirconium carbide, hafnium carbide, niobium carbide, tantalum carbide, mixtures thereof, and solid solutions thereof. The cemented carbide material also comprises a binder including at least one of cobalt, a cobalt alloy, nickel, a nickel alloy, iron, and an iron alloy. Embodiments of the cutting inserts are suitable for use on, for example, rotary cone earth-boring bits and fixed cutter earth-boring bits. A hybrid cemented carbide material comprising first regions of cemented carbide based on tungsten carbide and cobalt, dispersed in a continuous region of cemented carbide material comprising cubic carbides also is disclosed and is useful in cutting inserts of earth-boring bits.

3 Claims, 12 Drawing Sheets

(51) Int. Cl.

| | |
|---|---|
| ***C22C 29/00*** | (2006.01) |
| *B22F 5/00* | (2006.01) |

(56) References Cited

U.S. PATENT DOCUMENTS

| | | | |
|---|---|---|---|
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,240,840 | A | 5/1941 | Fischer |
| 2,246,237 | A | 6/1941 | Benninghoff |
| 2,283,280 | A | 5/1942 | Nell |
| 2,299,207 | A | 10/1942 | Bevillard |
| 2,351,827 | A | 6/1944 | McAllister |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |
| 3,093,850 | A | 6/1963 | Kelso |
| 3,368,881 | A | 2/1968 | Abkowitz et al. |
| 3,471,921 | A | 10/1969 | Feenstra |
| 3,482,295 | A | 12/1969 | Trent |
| 3,490,901 | A | 1/1970 | Hachisuka et al. |
| 3,581,835 | A | 6/1971 | Stebley |
| 3,629,887 | A | 12/1971 | Urbanic |
| 3,660,050 | A | 5/1972 | Iler et al. |
| 3,757,879 | A | 9/1973 | Wilder et al. |
| 3,762,882 | A | 10/1973 | Grutza |
| 3,776,655 | A | 12/1973 | Urbanic |
| 3,782,848 | A | 1/1974 | Pfeifer |
| 3,806,270 | A | 4/1974 | Tanner et al. |
| 3,812,548 | A | 5/1974 | Theuerkaue |
| 3,855,444 | A | 12/1974 | Palena |
| 3,889,516 | A | 6/1975 | Yankee et al. |
| RE28,645 | E | 12/1975 | Aoki et al. |
| 3,936,295 | A | 2/1976 | Cromwell et al. |
| 3,942,954 | A | 3/1976 | Frehn |
| 3,980,549 | A | 9/1976 | Grutza |
| 3,987,859 | A | 10/1976 | Lichte |
| 4,009,027 | A | 2/1977 | Naidich et al. |
| 4,017,480 | A | 4/1977 | Baum |
| 4,047,828 | A | 9/1977 | Makely |
| 4,094,709 | A | 6/1978 | Rozmus |
| 4,097,180 | A | 6/1978 | Kwieraga |
| 4,097,275 | A | 6/1978 | Horvath |
| 4,105,049 | A | 8/1978 | Anderson |
| 4,106,382 | A | 8/1978 | Salje et al. |
| 4,126,652 | A | 11/1978 | Oohara et al. |
| 4,128,136 | A | 12/1978 | Generoux |
| 4,170,499 | A | 10/1979 | Thomas et al. |
| 4,181,505 | A | 1/1980 | De Vries et al. |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,270,952 | A | 6/1981 | Kobayashi |
| 4,276,788 | A | 7/1981 | van Nederveen |
| 4,277,106 | A | 7/1981 | Sahley |
| 4,277,108 | A | 7/1981 | Wallace |
| 4,306,139 | A | 12/1981 | Shinozaki et al. |
| 4,311,490 | A | 1/1982 | Bovenkerk et al. |
| 4,325,994 | A | 4/1982 | Kitashima et al. |
| 4,327,156 | A | 4/1982 | Dillon et al. |
| 4,331,741 | A | 5/1982 | Wilson |
| 4,340,327 | A | 7/1982 | Martins |
| 4,341,557 | A | 7/1982 | Lizenby |
| 4,351,401 | A | 9/1982 | Fielder |
| 4,376,793 | A | 3/1983 | Jackson |
| 4,389,952 | A | 6/1983 | Dreier et al. |
| 4,396,321 | A | 8/1983 | Holmes |
| 4,398,952 | A | 8/1983 | Drake |
| 4,423,646 | A | 1/1984 | Bernhardt |
| 4,478,297 | A | 10/1984 | Radtke |
| 4,497,358 | A | 2/1985 | Gnadig et al. |
| 4,499,048 | A | 2/1985 | Hanejko |
| 4,499,795 | A | 2/1985 | Radtke |
| 4,520,882 | A | 6/1985 | van Nederveen |
| 4,526,748 | A | 7/1985 | Rozmus |
| 4,547,104 | A | 10/1985 | Holmes |
| 4,547,337 | A | 10/1985 | Rozmus |
| 4,550,532 | A | 11/1985 | Fletcher, Jr. et al. |
| 4,552,232 | A | 11/1985 | Frear |
| 4,553,615 | A | 11/1985 | Grainger |
| 4,554,130 | A | 11/1985 | Ecer |
| 4,562,990 | A | 1/1986 | Rose |
| 4,574,011 | A | 3/1986 | Bonjour et al. |
| 4,579,713 | A | 4/1986 | Lueth |
| 4,587,174 | A | 5/1986 | Yoshimura et al. |
| 4,592,685 | A | 6/1986 | Beere |
| 4,596,694 | A | 6/1986 | Rozmus |
| 4,597,456 | A | 7/1986 | Ecer |
| 4,597,730 | A | 7/1986 | Rozmus |
| 4,604,106 | A | 8/1986 | Hall |
| 4,604,781 | A | 8/1986 | Rankin, III |
| 4,605,343 | A | 8/1986 | Hibbs, Jr. et al. |
| 4,609,577 | A | 9/1986 | Long |
| 4,630,693 | A | 12/1986 | Goodfellow |
| 4,642,003 | A | 2/1987 | Yoshimura |
| 4,646,857 | A | 3/1987 | Thompson |
| 4,649,086 | A | 3/1987 | Johnson |
| 4,656,002 | A | 4/1987 | Lizenby et al. |
| 4,662,461 | A | 5/1987 | Garrett |
| 4,667,756 | A | 5/1987 | King et al. |
| 4,686,080 | A | 8/1987 | Hara et al. |
| 4,686,156 | A | 8/1987 | Baldoni, II et al. |
| 4,694,919 | A | 9/1987 | Barr |
| 4,708,542 | A | 11/1987 | Emanuelli |
| 4,722,405 | A | 2/1988 | Langford |
| 4,729,789 | A | 3/1988 | Ide et al. |
| 4,734,339 | A | 3/1988 | Schachner et al. |
| 4,735,656 | A | 4/1988 | Schaefer et al. |
| 4,743,515 | A | 5/1988 | Fischer et al. |
| 4,744,943 | A | 5/1988 | Timm |
| 4,749,053 | A | 6/1988 | Hollingshead |
| 4,752,159 | A | 6/1988 | Howlett |
| 4,752,164 | A | 6/1988 | Leonard, Jr. |
| 4,761,844 | A | 8/1988 | Turchan |
| 4,779,440 | A | 10/1988 | Cleve et al. |
| 4,780,274 | A | 10/1988 | Barr |
| 4,804,049 | A | 2/1989 | Barr |
| 4,809,903 | A | 3/1989 | Eylon et al. |
| 4,813,823 | A | 3/1989 | Bieneck |
| 4,831,674 | A | 5/1989 | Bergstrom et al. |
| 4,838,366 | A | 6/1989 | Jones |
| 4,861,350 | A | 8/1989 | Phaal et al. |
| 4,871,377 | A | 10/1989 | Frushour |
| 4,881,431 | A | 11/1989 | Bieneck |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,934,040 | A | 6/1990 | Turchan |
| 4,943,191 | A | 7/1990 | Schmidtt |
| 4,956,012 | A | 9/1990 | Jacobs et al. |
| 4,968,348 | A | 11/1990 | Abkowitz et al. |
| 4,971,485 | A | 11/1990 | Nomura et al. |
| 4,991,670 | A | 2/1991 | Fuller et al. |
| 5,000,273 | A | 3/1991 | Horton et al. |
| 5,010,945 | A | 4/1991 | Burke |
| 5,030,598 | A | 7/1991 | Hsieh |
| 5,032,352 | A | 7/1991 | Meeks et al. |
| 5,041,261 | A | 8/1991 | Buljan et al. |
| 5,049,450 | A | 9/1991 | Dorfman et al. |
| RE33,753 | E | 11/1991 | Vacchiano et al. |
| 5,067,860 | A | 11/1991 | Kobayashi et al. |
| 5,075,315 | A | 12/1991 | Rasmussen |
| 5,075,316 | A | 12/1991 | Hubele |
| 5,080,538 | A | 1/1992 | Schmidtt |

(56) References Cited

U.S. PATENT DOCUMENTS 5,090,491 A 2/1992 Tibbitts et al.
5,092,412 A 3/1992 Walk
5,094,571 A 3/1992 Ekerot
5,096,465 A 3/1992 Chen et al.
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,126,206 A 6/1992 Garg et al.
5,127,776 A 7/1992 Glimpel
5,135,801 A 8/1992 Nyström et al.
5,161,898 A 11/1992 Drake
5,174,700 A 12/1992 Sgarbi et al.
5,179,772 A 1/1993 Braun et al.
RE34,180 E * 2/1993 Nemeth et al. ..... 428/547
5,186,739 A 2/1993 Isobe et al.
5,203,513 A 4/1993 Keller et al.
5,203,932 A 4/1993 Kato et al.
5,217,081 A 6/1993 Waldenström et al.
5,232,522 A 8/1993 Doktycz et al.
5,250,355 A 10/1993 Newman et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,335,738 A 8/1994 Waldenström et al.
5,338,135 A 8/1994 Noguchi et al.
5,346,316 A 9/1994 Okada et al.
5,348,806 A 9/1994 Kojo et al.
5,354,155 A 10/1994 Adams
5,359,772 A 11/1994 Carlsson et al.
5,373,907 A 12/1994 Weaver
5,376,329 A 12/1994 Morgan et al.
5,413,438 A 5/1995 Turchan
5,423,899 A 6/1995 Krall et al.
5,429,459 A 7/1995 Palm
5,433,280 A 7/1995 Smith
5,438,108 A 8/1995 Umemura et al.
5,438,858 A 8/1995 Friedrichs
5,443,337 A 8/1995 Katayama
5,447,549 A 9/1995 Yoshimura
5,452,771 A 9/1995 Blackman et al.
5,467,669 A 11/1995 Stroud
5,474,407 A 12/1995 Rodel et al.
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,492,186 A 2/1996 Overstreet et al.
5,496,137 A 3/1996 Ochayon et al.
5,498,142 A 3/1996 Mills
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,238 A 10/1996 Allebach et al.
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,286 A 3/1997 Anthon
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,672,382 A 9/1997 Lux
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,704,736 A 1/1998 Giannetti
5,712,030 A 1/1998 Goto et al.
5,718,948 A 2/1998 Ederyd et al.
5,732,783 A 3/1998 Truax et al.
5,733,078 A 3/1998 Matsushita et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Gunter et al.
5,755,298 A 5/1998 Langford, Jr. et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,791,833 A 8/1998 Niebauer
5,792,403 A 8/1998 Massa et al.
5,803,152 A 9/1998 Dolman et al.
5,806,934 A 9/1998 Massa et al.
5,830,256 A 11/1998 Northrop et al.
5,851,094 A 12/1998 Stand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,893,204 A 4/1999 Symonds
5,897,830 A 4/1999 Abkowitz et al.
5,899,257 A 5/1999 Alleweireldt et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,012,882 A 1/2000 Turchan
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Gunter et al.
6,086,980 A 7/2000 Foster et al.
6,089,123 A 7/2000 Chow et al.
6,109,377 A 8/2000 Massa et al.
6,109,677 A 8/2000 Anthony
6,117,493 A 9/2000 North
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.
6,214,287 B1 4/2001 Waldenström
6,217,992 B1 4/2001 Grab

(56) References Cited

U.S. PATENT DOCUMENTS 6,220,117 B1 4/2001 Butcher
6,227,188 B1 5/2001 Tankala et al.
6,228,134 B1 5/2001 Erickson
6,228,139 B1 5/2001 Oskarsson
6,234,261 B1 5/2001 Evans et al.
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,302,224 B1 10/2001 Sherwood, Jr.
6,326,582 B1 12/2001 North
6,345,941 B1 2/2002 Fang et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,394,711 B1 5/2002 Brosius
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,475,647 B1 11/2002 Mendez Acevedo et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,541,124 B1 4/2003 Suggs
6,544,308 B2 4/2003 Griffin et al.
6,546,991 B2 4/2003 Dworog et al.
6,551,035 B1 4/2003 Bruhn et al.
6,554,548 B1 4/2003 Grab et al.
6,562,462 B2 5/2003 Griffin et al.
6,576,182 B1 6/2003 Ravagni et al.
6,582,126 B2 6/2003 North
6,585,064 B2 7/2003 Griffin et al.
6,585,864 B1 7/2003 Fisher et al.
6,589,640 B2 7/2003 Griffin et al.
6,599,467 B1 7/2003 Yamaguchi et al.
6,607,693 B1 8/2003 Saito et al.
6,607,835 B2 8/2003 Fang et al.
6,620,375 B1 9/2003 Tank et al.
6,637,528 B2 10/2003 Nishiyama et al.
6,638,609 B2 10/2003 Nordgren et al.
6,648,068 B2 11/2003 Dewey et al.
6,649,682 B1 11/2003 Breton et al.
6,651,757 B2 11/2003 Belnap et al.
6,655,481 B2 12/2003 Findley et al.
6,655,882 B2 12/2003 Heinrich et al.
6,676,863 B2 1/2004 Christiaens et al.
6,682,780 B2 1/2004 Tzatzov et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,723,389 B2 4/2004 Kobayashi et al.
6,725,953 B2 4/2004 Truax et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,767,505 B2 7/2004 Witherspoon et al.
6,772,849 B2 8/2004 Oldham et al.
6,782,958 B2 8/2004 Liang et al.
6,799,648 B2 10/2004 Brandenberg et al.
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,884,496 B2 4/2005 Westphal et al.
6,884,497 B2 4/2005 Sulin et al.
6,892,793 B2 5/2005 Liu et al.
6,899,495 B2 5/2005 Hansson et al.
6,918,942 B2 7/2005 Hatta et al.
6,932,172 B2 8/2005 Dvorachek
6,933,049 B2 8/2005 Wan et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,017,677 B2 3/2006 Keshavan et al.
7,036,611 B2 5/2006 Radford et al.
7,044,243 B2 5/2006 Kembaiyan et al.
7,048,081 B2 5/2006 Smith et al.
7,070,666 B2 7/2006 Druschitz et al.
7,080,998 B2 7/2006 Hall et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,152,701 B2 12/2006 Butland et al.
7,172,142 B2 2/2007 Taylor et al.
7,175,404 B2 2/2007 Kondo et al.
7,192,660 B2 3/2007 Ruppi
7,204,117 B2 4/2007 Friedrichs
7,207,401 B2 4/2007 Dewey et al.
7,207,750 B2 4/2007 Annanolli et al.
7,216,727 B2 5/2007 Wardley
7,231,984 B2 6/2007 Jaensch
7,234,541 B2 6/2007 Scott et al.
7,234,550 B2 6/2007 Azar et al.
7,235,211 B2 6/2007 Griffo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,262,240 B1 8/2007 Breton et al.
7,267,187 B2 9/2007 Kembaiyan
7,267,543 B2 9/2007 Freidhoff et al.
7,270,679 B2 9/2007 Istephanous et al.
7,296,497 B2 11/2007 Kugelberg et al.
7,350,599 B2 4/2008 Lockwood et al.
7,381,283 B2 6/2008 Lee et al.
7,384,413 B2 6/2008 Gross et al.
7,384,443 B2 6/2008 Mirchandani et al.
7,395,882 B2 7/2008 Oldham et al.
7,410,610 B2 8/2008 Woodfield et al.
7,487,849 B2 2/2009 Radtke
7,494,507 B2 2/2009 Dixon
7,497,280 B2 3/2009 Brackin et al.
7,497,396 B2 3/2009 Splinter et al.
7,513,320 B2 4/2009 Mirchandani et al.
7,524,351 B2 4/2009 Hua et al.
7,556,668 B2 7/2009 Eason et al.
7,575,620 B2 8/2009 Terry et al.
7,625,157 B2 12/2009 Prichard et al.
7,632,323 B2 12/2009 Ganguly et al.
7,661,491 B2 2/2010 Kembaiyan et al.
7,687,156 B2 3/2010 Fang
7,703,555 B2 4/2010 Overstreet
7,794,830 B2 * 9/2010 Kusoffsky et al. ..... 428/325
7,810,588 B2 10/2010 McClain et al.
7,832,456 B2 11/2010 Calnan et al.
7,832,457 B2 11/2010 Calnan et al.

(56) References Cited

U.S. PATENT DOCUMENTS

| | | | | |
|---|---|---|---|---|
| 7,846,551 | B2 | 12/2010 | Fang et al. | |
| 7,887,747 | B2 | 2/2011 | Iwasaki et al. | |
| 7,954,569 | B2 | 6/2011 | Mirchandani et al. | |
| 8,007,714 | B2 | 8/2011 | Mirchandani et al. | |
| 8,007,922 | B2 | 8/2011 | Mirchandani et al. | |
| 8,025,112 | B2 | 9/2011 | Mirchandani et al. | |
| 8,087,324 | B2 | 1/2012 | Mirchandani et al. | |
| 8,109,177 | B2 | 2/2012 | Kembaiyan | |
| 8,137,816 | B2 | 3/2012 | Fang et al. | |
| 8,141,665 | B2 | 3/2012 | Ganz | |
| 8,221,517 | B2 | 7/2012 | Mirchandani et al. | |
| 8,225,886 | B2 | 7/2012 | Mirchandani et al. | |
| 8,272,816 | B2 | 9/2012 | Mirchandani | |
| 8,308,096 | B2 | 11/2012 | Mirchandani et al. | |
| 8,312,941 | B2 | 11/2012 | Mirchandani et al. | |
| 8,318,063 | B2 | 11/2012 | Mirchandani et al. | |
| 8,322,465 | B2 | 12/2012 | Mirchandani | |
| 8,459,380 | B2 | 6/2013 | Mirchandani et al. | |
| 2002/0004105 | A1 | 1/2002 | Kunze et al. | |
| 2003/0010409 | A1 | 1/2003 | Kunze et al. | |
| 2003/0041922 | A1 | 3/2003 | Hirose et al. | |
| 2003/0219605 | A1 | 11/2003 | Molian et al. | |
| 2004/0013558 | A1 | 1/2004 | Kondoh et al. | |
| 2004/0105730 | A1 | 6/2004 | Nakajima | |
| 2004/0228695 | A1 | 11/2004 | Clauson | |
| 2004/0234820 | A1 | 11/2004 | Majagi | |
| 2004/0244540 | A1 | 12/2004 | Oldham et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0019114 | A1 | 1/2005 | Sung | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0194073 | A1 | 9/2005 | Hamano et al. | |
| 2005/0211475 | A1 | 9/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0185773 | A1 | 8/2006 | Chiovelli | |
| 2006/0286410 | A1 | 12/2006 | Ahigren et al. | |
| 2006/0288820 | A1 | 12/2006 | Mirchandani et al. | |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0126334 | A1 | 6/2007 | Nakamura et al. | |
| 2007/0163679 | A1 | 7/2007 | Fujisawa et al. | |
| 2007/0193782 | A1 | 8/2007 | Fang et al. | |
| 2008/0011519 | A1 | 1/2008 | Smith et al. | |
| 2008/0101977 | A1 | 5/2008 | Eason et al. | |
| 2008/0196318 | A1 | 8/2008 | Bost et al. | |
| 2008/0302576 | A1 | 12/2008 | Michandani et al. | |
| 2009/0032501 | A1 | 2/2009 | Swingley et al. | |
| 2009/0041612 | A1 | 2/2009 | Fang et al. | |
| 2009/0136308 | A1 | 5/2009 | Newitt et al. | |
| 2009/0180915 | A1 | 7/2009 | Mirchandani et al. | |
| 2009/0301788 | A1 | 12/2009 | Stevens et al. | |
| 2010/0044114 | A1 | 2/2010 | Mirchandani et al. | |
| 2010/0278603 | A1 | 11/2010 | Fang et al. | |
| 2010/0290849 | A1* | 11/2010 | Mirchandani | 408/144 |
| 2010/0323213 | A1 | 12/2010 | Aitchison et al. | |
| 2011/0107811 | A1 | 5/2011 | Mirchandani et al. | |
| 2011/0265623 | A1 | 11/2011 | Mirchandani et al. | |
| 2011/0284179 | A1 | 11/2011 | Stevens et al. | |
| 2011/0287238 | A1 | 11/2011 | Stevens et al. | |
| 2011/0287924 | A1 | 11/2011 | Stevens | |
| 2012/0237386 | A1 | 9/2012 | Mirchandani et al. | |
| 2012/0240476 | A1 | 9/2012 | Mirchandani et al. | |
| 2012/0282051 | A1 | 11/2012 | Mirchandani | |
| 2012/0285293 | A1 | 11/2012 | Mirchandani et al. | |
| 2012/0321498 | A1 | 12/2012 | Mirchandani | |
| 2013/0025127 | A1 | 1/2013 | Mirchandani et al. | |
| 2013/0025813 | A1 | 1/2013 | Mirchandani et al. | |
| 2013/0026274 | A1 | 1/2013 | Mirchandani et al. | |
| 2013/0028672 | A1 | 1/2013 | Mirchandani et al. | |
| 2013/0036872 | A1 | 2/2013 | Mirchandani et al. | |
| 2013/0037985 | A1 | 2/2013 | Mirchandani | |
| 2013/0043615 | A1 | 2/2013 | Mirchandani et al. | |
| 2013/0048701 | A1 | 2/2013 | Mirchandani et al. | |
| 2013/0075165 | A1* | 3/2013 | Coleman et al. | 175/374 |

FOREIGN PATENT DOCUMENTS

| | | | |
|---|---|---|---|
| CA | 1158073 | A | 12/1983 |
| CA | 1250156 | A | 2/1989 |
| CA | 2022065 | A1 | 2/1991 |
| CA | 2120332 | | 6/1993 |
| CA | 2107004 | C | 5/1996 |
| CA | 2228398 | A1 | 2/1997 |
| CA | 2198985 | A1 | 9/1998 |
| CA | 2108274 | C | 7/2000 |
| CA | 2212197 | C | 10/2000 |
| CA | 2201969 | C | 2/2003 |
| CA | 2213169 | C | 3/2005 |
| CA | 2498073 | A1 | 8/2006 |
| CA | 2556132 | A1 | 2/2007 |
| CA | 2570937 | A1 | 6/2007 |
| CA | 2357407 | C | 1/2008 |
| DE | 19634314 | A1 | 1/1998 |
| DE | 10300283 | B3 | 6/2004 |
| DE | 102006030661 | A1 | 1/2008 |
| DE | 102007006943 | A1 | 8/2008 |
| EP | 0157625 | A2 | 10/1985 |
| EP | 0264674 | A2 | 4/1988 |
| EP | 0453428 | A1 | 10/1991 |
| EP | 0605585 | B1 | 8/1995 |
| EP | 0641620 | B1 | 2/1998 |
| EP | 0995876 | A2 | 4/2000 |
| EP | 1065021 | A1 | 1/2001 |
| EP | 1066901 | A2 | 1/2001 |
| EP | 1106706 | A1 | 6/2001 |
| EP | 0759480 | B1 | 1/2002 |
| EP | 1077268 | B1 | 5/2003 |
| EP | 1244531 | B1 | 10/2004 |
| EP | 1686193 | A2 | 8/2006 |
| EP | 1788104 | A1 | 5/2007 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2064619 | A | 6/1981 |
| GB | 2158744 | A | 11/1985 |
| GB | 2218931 | A | 11/1989 |
| GB | 2315452 | A | 2/1998 |
| GB | 2324752 | A | 11/1998 |
| GB | 2352727 | A | 2/2001 |
| GB | 2384745 | A | 8/2003 |
| GB | 2385350 | A | 8/2003 |
| GB | 2393449 | A | 3/2004 |
| GB | 2397832 | A | 8/2004 |
| GB | 2409467 | A | 6/2005 |
| GB | 2435476 | A | 8/2007 |
| JP | 51-114307 | | 10/1976 |
| JP | 51-124876 | A | 10/1976 |
| JP | 56-52604 | U | 5/1981 |
| JP | 59-54510 | A | 3/1984 |
| JP | 59-56501 | A | 4/1984 |
| JP | 59-67333 | A | 4/1984 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 60-224790 | A | 11/1985 |
| JP | 61-226231 | A | 10/1986 |
| JP | 61-243103 | A | 10/1986 |
| JP | 61057123 | B | 12/1986 |
| JP | 62-34710 | A | 2/1987 |

(56) References Cited

FOREIGN PATENT DOCUMENTS

| | | | |
|---|---|---|---|
| JP | 62-063005 | A | 3/1987 |
| JP | 62-218010 | A | 9/1987 |
| JP | 62-278250 | A | 12/1987 |
| JP | 1-171725 | A | 7/1989 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 04-217414 | A | 8/1992 |
| JP | 5-50314 | A | 3/1993 |
| JP | 5-92329 | A | 4/1993 |
| JP | H05-64288 | U | 8/1993 |
| JP | H03-119090 | U | 6/1995 |
| JP | 7-276105 | A | 10/1995 |
| JP | 8-120308 | A | 5/1996 |
| JP | H8-209284 | | 8/1996 |
| JP | 8-294805 | A | 11/1996 |
| JP | 9-11005 | A | 1/1997 |
| JP | 9-192930 | A | 7/1997 |
| JP | 9-253779 | A | 9/1997 |
| JP | 10-138033 | A | 5/1998 |
| JP | 10-156607 | A | 6/1998 |
| JP | 10219385 | A | 8/1998 |
| JP | H10-511740 | A | 11/1998 |
| JP | 11-10409 | A | 1/1999 |
| JP | 11-300516 | A | 11/1999 |
| JP | 2000-237910 | A | 9/2000 |
| JP | 2000-296403 | A | 10/2000 |
| JP | 2000-355725 | A | 12/2000 |
| JP | 2001-179517 | A | 7/2001 |
| JP | 2002-097885 | A | 4/2002 |
| JP | 2002-166326 | A | 6/2002 |
| JP | 2002-317596 | A | 10/2002 |
| JP | 2003-306739 | A | 10/2003 |
| JP | 2004-160591 | A | 6/2004 |
| JP | 2004-181604 | | 7/2004 |
| JP | 2004-190034 | A | 7/2004 |
| JP | 2004-315904 | A | 11/2004 |
| JP | 2005-111581 | A | 4/2005 |
| JP | 2005-519448 | A | 6/2005 |
| JP | 2006-524173 | A | 10/2006 |
| JP | 2006-328477 | A | 12/2006 |
| KR | 20050055268 | | 6/2005 |
| RU | 2135328 | C1 | 8/1999 |
| RU | 2173241 | C2 | 2/2000 |
| RU | 2167262 | C2 | 5/2001 |
| SU | 967786 | A1 | 10/1982 |
| SU | 975369 | A1 | 11/1982 |
| SU | 990423 | A1 | 1/1983 |
| SU | 1269922 | A | 11/1986 |
| SU | 1292917 | A1 | 2/1987 |
| SU | 1350322 | | 11/1987 |
| UA | 6742 | | 12/1994 |
| UA | 63469 | C2 | 1/2006 |
| UA | 23749 | U | 6/2007 |
| WO | WO 92/05009 | A1 | 4/1992 |
| WO | WO 92/22390 | A1 | 12/1992 |
| WO | WO 97/19201 | A1 | 5/1997 |
| WO | WO 97/34726 | A1 | 9/1997 |
| WO | WO 98/28455 | A1 | 7/1998 |
| WO | WO 99/13121 | A1 | 3/1999 |
| WO | WO 97/00734 | A1 | 7/1999 |
| WO | WO 99/36590 | A1 | 7/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | WO 2011/000348 | A1 | 1/2011 |
| WO | WO 2011/008439 | A2 | 1/2011 |

OTHER PUBLICATIONS

Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.

Deng, X. et al., "Mechanical Properties of a Hybrid Cemented Carbide Composite," International Journal of Refractory Metals and Hard Materials, Elsevier Science Ltd., vol. 19, 2001, pp. 547-552.

Gurland, Joseph, "Application of Quantitative Microscopy to Cemented Carbides," Practical Applications of Quantitative Matellography, ASTM Special Technical Publication 839, ASTM 1984, pp. 65-84.

Hayden, Matthew and Lyndon Scott Stephens, "Experimental Results for a Heat-Sink Mechanical Seal," Tribology Transactions, 48, 2005, pp. 352-361.

Metals Handbook, vol. 16 Machining, "Cemented Carbides" (ASM International 1989), pp. 71-89.

Metals Handbook, vol. 16 Machining, "Tapping" (ASM International 1989), pp. 255-267.

Peterman, Walter, "Heat-Sink Compound Protects the Unprotected," Welding Design and Fabrication, Sep. 2003, pp. 20-22.

Shi et al., "Composite Ductility—The Role of Reinforcement and Matrix", TMS Meeting, Las Vegas, NV, Feb. 12-16, 1995, 10 pages.

Sriram, et al., "Effect of Cerium Addition on Microstructures of Carbon-Alloyed Iron Aluminides," Bull. Mater. Sci., vol. 28, No. 6, Oct. 2005, pp. 547-554.

Tracey et al., "Development of Tungsten Carbide-Cobalt-Ruthenium Cutting Tools for Machining Steels" Proceedings Annual Microprogramming Workshop, vol. 14, 1981, pp. 281-292.

Underwood, *Quantitative Stereology*, pp. 23-108 (1970).

Vander Vort, "Introduction to Quantitative Metallography", Tech Notes, vol. 1, Issue 5, published by Buehler, Ltd. 1997, 6 pages.

J. Gurland, *Quantitative Microscopy*, R.T. DeHoff and F.N. Rhines, eds., McGraw-Hill Book Company, New York, 1968, pp. 279-290.

You Tube, "The Story Behind Kennametal's Beyond Blast", dated Sep. 14, 2010, http://www.youtube.com/watch?v=8_A-bYVwmU8 (3 pages) accessed on Oct. 14, 2010.

Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.

Pages from Kennametal site, https://www.kennametal.com/en-US/promotions/Beyond_Blast.jhtml (7 pages) accessed on Oct. 14, 2010.

ASM Materials Engineering Dictionary, J.R. Davis, Ed., ASM International, Fifth printing, Jan. 2006, p. 98.

Childs et al., "Metal Machining", 2000, Elsevier, p. 111.

Brookes, Kenneth J. A., "World Directory and Handbook of Hardmetals and Hard Materials", International Carbide Data, U.K. 1996, Sixth Edition, p. 42.

Firth Sterling grade chart, Allegheny Technologies, attached to Declaration of Prakash Mirchandani, Ph.D. as filed in U.S. Appl. No. 11/737,993 on Sep. 9, 2009.

Metals Handbook Desk Edition, definition of 'wear', 2nd Ed., J.R. Davis, Editor, ASM International 1998, p. 62.

McGraw-Hill Dictionary of Scientific and Technical Terms, 5th Edition, Sybil P. Parker, Editor in Chief, 1994, pp. 799, 800, 1933, and 2047.

ProKon Version 8.6, The Calculation Companion, Properties for W, Ti, Mo, Co, Ni and FE, Copyright 1997-1998, 6 pages.

(56) References Cited

OTHER PUBLICATIONS

TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
The Thermal Conductivity of Some Common Materials and Gases, The Engineering ToolBox, printed from http://www.engineeringtoolbox.com/thermal-conductivity-d_429.html on Dec. 15, 2011, 4 pages.
ASTM G65-04, Standard Test Method for Measuring Abrasion Using the Dry Sand, Nov. 1, 2004, printed from http://infostore.saiglobal.com.
Tool and Manufacturing Engineers Handbook, Fourth Edition, vol. 1, Machining, Society of Manufacturing Engineers, Chapter 12, vol. 1, 1983, pp. 12-110-12-114.
Beard, T. "The INS and OUTS of Thread Milling; Emphasis: Hole Making, Interview", Modern Machine Shop, Gardner Publications, Inc. 1991, vol. 64, No. 1, 5 pages.
Koelsch, J., "Thread Milling Takes on Tapping", Manufacturing Engineering, 1995, vol. 115, No. 4, 6 pages.
Johnson, M. "Tapping", Traditional Machining Processes, 1997, pp. 255-265.
"Thread Milling", Traditional Machining Processes, 1997, pp. 268-269.
Scientific Cutting Tools, "The Cutting Edge", 1998, printed on Feb. 1, 2000, 15 pages.
Helical Carbide Thread Mills, Schmarje Tool Company, 1998, 2 pages.
Pyrotek, Zyp Zircwash, www.pyrotek.info, Feb. 2003, 1 page.
Sims et al., "Casting Engineering", Superalloys II, Aug. 1987, pp. 420-426.
Sikkenga, "Cobalt and Cobalt Alloy Castings", Casting, vol. 15, ASM Handbook, ASM International, 2008, pp. 1114-1118.
Starck, H.C., Surface Technology, Powders for PTA-Welding, Lasercladding and other Wear Protective Welding Applications, Jan. 2011, 4 pages.
Ancormet® 101, Data Sheet, 0001-AM101-D-1, Hoeganaes, www.hoeganaes.com, 7 pages. (date unavailable).
Nassau, K. Ph.D. and Julia Nassau, "The History and Present Status of Synthetic Diamond, Part I and II", reprinted from The Lapidary Journal, Inc., vol. 32, No. 1, Apr. 1978; vol. 32, No. 2, May 1978, 15 pages.
Specialty Metals, "Tungchip Dispenser, An improved feeder design, to allow for accurate delivery of Tungsten Carbide granules into the molten weld pool, generated by a MIG (GMAW) welding system", (undated) 2 pages.
Dynalloy Industries, G.M.A.C.E, 2003, printed Jul. 8, 2009, 1 page.
Alloys International (Australasia) Pty. Ltd., "The Tungsten Carbide Vibratory Feeder System", (undated) 6 pages.
Dynalloy Industries, Hardhead Technology, Tungsten Carbide Pellets, 2003, printed Jul. 8, 2009, 1 page.
Lincoln Electric, MIG Carbide Vibratory Feeder Assembly, (undated) 1 page.
Wearshield Hardfacing Electrodes, Tungsten Carbide Products, (undated) 1 page.
Postalloy, The best in hardfacing, Postle Industries, Inc., (undated) 13 pages.
Postalloy, Postle Industries, Inc., Postalloy PS-98, Tungsten Matrix Alloy, (undated) 1 page.
Postalloy, Data Sheet, Postle Industries, Inc., Postalloy 299-SPL, (undated) 1 page.
Postalloy, Data Sheet, Postle Industries, Inc., Postalloy CP 63070, (undated) 1 page.
Postalloy, Data Sheet, Postle Industries, Inc., Postalloy 14 TC, (undated) 1 page.
Postalloy, Data Sheet, Postle Industries, Inc., Postalloy PS-98, A Tungsten Carbide Matrix Wire for Carbide Embedding, (undated) 1 page.
Industrial Renewal Services, Steel BOC (Basic Oxygen Furnace) & BOP (Basic Oxygen Process) Hoods, printed Nov. 8, 2007, 2 pages.
UWO Products, printed Nov. 8, 2007 from http://www.universalweld.com/products.htm, 2 pages.
Shi et al., "Study on shaping technology of nanocrystalline WC-Co composite powder", Rare Metal and Materials and Engineering, vol. 33, Suppl. 1, Jun. 2004, pp. 93-96. (English abstract).
Haynes et al., Physical Constants of Inorganic Compounds, CRC Handbook of Chemistry and Physics, 93rd Edition, Internet Version 2013, downloaded May 15, 2013, 2 pages.
"Percentage by Weight to Percentage by Volume Conversion Calculator", Roseller Sunga, n.d., May 15, 2013, http://www.handymath.com/cgi-bin/dnstywtvol.cgi?sumit=Entry, 1 page.
Office Action mailed Feb. 27, 2013 in U.S. Appl. No. 13/550,690.
Office Action mailed Jan. 23, 2013 in U.S. Appl. No. 13/652,508.
Office Action mailed Feb. 5, 2013 in U.S. Appl. No. 13/652,503.
Office Action mailed Jul. 5, 2013 in U.S. Appl. No. 13/652,503.
Office Action mailed Apr. 5, 2013 in U.S. Appl. No. 13/632,177.
Restriction Requirement mailed Jan. 3, 2013 in U.S. Appl. No. 13/632,178.
Office Action mailed Mar. 6, 2013 in U.S. Appl. No. 13/632,178.
Office Action mailed May 22, 2013 in U.S. Appl. No. 13/487,323.
Office Action mailed Jun. 28, 2012 in U.S. Appl. No. 13/222,324.
Office Action mailed Jul. 11, 2012 in U.S. Appl. No. 13/222,324.
Office Action mailed Nov. 6, 2012 in U.S. Appl. No. 13/222,324.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Mar. 28, 2012 in U.S. Appl. No. 11/167,811.
Notice of Allowance mailed Jul. 1, 2013 in U.S. Appl. No. 11/167,811.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12/397,597.
Advisory Action mailed Jan. 26, 2012 in U.S. Appl. No. 12/397,597.
Office Action mailed Apr. 13, 2012 in U.S. Appl. No. 12/397,597.
Office Action mailed Nov. 16, 2012 in U.S. Appl. No. 12/397,597.
Office Action mailed Jun. 20, 2013 in U.S. Appl. No. 12/397,597.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Office Action mailed Oct. 31, 2008 in U.S. Appl. No. 10/903,198.
Office Action mailed Apr. 17, 2009 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.

(56) References Cited

OTHER PUBLICATIONS

Decision on Appeal mailed Jun. 3, 2013 in U.S. Appl. No. 10/903,198.
Office Action mailed Oct. 13, 2011 in U.S. Appl. No. 12/179,999.
Notice of Allowance mailed Apr. 30, 2012 in U.S. Appl. No. 12/179,999.
Office Action mailed Aug. 29, 2011 in U.S. Appl. No. 12/476,738.
Office Action mailed Dec. 21, 2011 in U.S. Appl. No. 12/476,738.
Notice of Allowance mailed Apr. 17, 2012 in U.S. Appl. No. 12/476,738.
Corrected Notice of Allowability mailed Jun. 21, 2012 in U.S. Appl. No. 12/476,738.
Office Action mailed Dec. 5, 2011 in U.S. Appl. No. 13/182,474.
Office Action mailed Apr. 27, 2012 in U.S. Appl. No. 13/182,474.
Notice of Allowance mailed Jul. 18, 2012 in U.S. Appl. No. 13/182,474.
Notification of Reopening of Prosecution Due to Consideration of an Information Disclosure Statement Filed After Mailing of a Notice of Allowance mailed Oct. 10, 2012 in U.S. Appl. No. 13/182,474.
Office Action mailed May 16, 2013 in U.S. Appl. No. 13/182,474.
Office Action mailed Jun. 1, 2001 in U.S. Appl. No. 09/460,540.
Office Action mailed Dec. 1, 2001 in U.S. Appl. No. 09/460,540.
Office Action mailed Mar. 15, 2002 in U.S. Appl. No. 09/460,540.
Office Action mailed Jun. 18, 2002 in U.S. Appl. No. 09/460,540.
Notice of Allowance mailed Oct. 21, 2002 in U.S. Appl. No. 09/460,540.
Office Action mailed Jan. 16, 2007 in U.S. Appl. No. 11/013,842.
Office Action mailed Jul. 16, 2008 in U.S. Appl. No. 11/013,842.
Office Action mailed Jul. 30, 2007 in U.S. Appl. No. 11/013,842.
Notice of Allowance mailed Feb. 4, 2008 in U.S. Appl. No. 11/013,842.
Notice of Allowance mailed Nov. 26, 2008 in U.S. Appl. No. 11/013,842.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Aug. 31, 2007 in U.S. Appl. No. 11/206,368.
Office Action mailed Feb. 28, 2008 in U.S. Appl. No. 11/206,368.
Pre-Appeal Conference Decision mailed Jun. 19, 2008 in U.S. Appl. No. 11/206,368.
Notice of Allowance mailed Nov. 13, 2008 in U.S. Appl. No. 11/206,368.
Office Action mailed Apr. 30, 2009 in U.S. Appl. No. 11/206,368.
Notice of Allowance mailed Nov. 30, 2009 in U.S. Appl. No. 11/206,368.
Office Action mailed Sep. 2, 2011 in U.S. Appl. No. 12/850,003.
Notice of Allowance mailed Nov. 15, 2011 in U.S. Appl. No. 12/850,003.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Office Action mailed Mar. 15, 2012 in U.S. Appl. No. 12/464,607.
Notice of Allowance mailed Apr. 9, 2012 in U.S. Appl. No. 12/464,607.
Notice of Allowance mailed Jul. 16, 2012 in U.S. Appl. No. 12/464,607.
Office Action mailed Oct. 31, 2011 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,478.
Supplemental Notice of Allowability mailed Jun. 29, 2012 in U.S. Appl. No. 13/207,478.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Notice of Allowance mailed May 9, 2012 in U.S. Appl. No. 11/585,408.
Notice of Allowance mailed Jul. 20, 2012 in U.S. Appl. No. 11/585,408.
Corrected Notice of Allowability mailed Oct. 18, 2012 in U.S. Appl. No. 11/585,408.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action mailed Jan. 6, 2012 in U.S. Appl. No. 11/737,993.
Advisory Action Before the Filing of an Appeal Brief mailed Mar. 22, 2012 in U.S. Appl. No. 11/737,993.
Notice of Allowance mailed Jul. 25, 2012 in U.S. Appl. No. 11/737,993.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Mar. 19, 2012 in U.S. Appl. No. 12/196,951.
Notice of Allowance mailed Jul. 31, 2012 in U.S. Appl. No. 12/196,951.
Office Action mailed Nov. 14, 2011 in U.S. Appl. No. 12/502,277.
Office Action mailed Jan. 20, 2012 in U.S. Appl. No. 12/502,277.
Notice of Allowance mailed Jul. 10, 2012 in U.S. Appl. No. 12/502,277.
Supplemental Notice of Allowability mailed Jul. 20, 2012 in U.S. Appl. No. 12/502,277.
Office Action mailed Oct. 4, 2012 in U.S. Appl. No. 13/491,638.
Notice of Allowance mailed Mar. 6, 2013 in U.S. Appl. No. 13/491,638.

* cited by examiner

CUTTING INSERTS FOR EARTH-BORING BITS

CROSS REFERENCE TO RELATED APPLICATION

This application claims priority under 35 U.S.C. §119(e) to U.S. Provisional Patent Application Ser. No. 61/537,670, filed Sep. 22, 2011, which is incorporated by reference herein in its entirety.

BACKGROUND OF THE TECHNOLOGY

1. Field of the Technology

The present disclosure relates to cutting inserts adapted for use in earth-boring bits and in other articles of manufacture.

2. Description of the Background of the Technology

Cemented carbides are composites including a discontinuous hard phase dispersed in a continuous relatively soft metallic binder phase. The dispersed (discontinuous) phase typically comprises transition metal carbide, nitride, silicide, and/or oxide, wherein the transition metal is selected from, for example, titanium, vanadium, chromium, zirconium, hafnium, molybdenum, niobium, tantalum, and tungsten. The binder phase typically comprises at least one of cobalt, a cobalt alloy, nickel, a nickel alloy, iron, and an iron alloy. Alloying elements such as, for example, chromium, molybdenum, boron, tungsten, tantalum, titanium, and niobium may be included in the binder to enhance certain properties of the composite material. The binder phase binds or "cements" the dispersed hard grains together, and the composite exhibits an advantageous combination of the physical properties of the discontinuous and continuous phases. Although the discontinuous hard phase of such composites may not include metal carbides, the commercially available versions typically include carbides as the discontinuous hard phase. Therefore, the composites are commonly referred to as "cemented carbides" even if carbides are absent or only constitute a portion of the discontinuous hard phase. Accordingly, references herein to "cemented carbides", both in the present description and the claims, refer to such materials whether or not they include metallic carbides.

Numerous cemented carbide types or "grades" are produced by varying parameters that may include the composition of the materials in the dispersed and/or continuous phases, the average size of the dispersed phase regions, and the volume fractions of the discontinuous and continuous phases. Cemented carbides including a dispersed tungsten carbide phase and a cobalt or cobalt alloy binder phase are the most commercially important of the commonly available cemented carbide grades. Conventional cemented carbide grades are available as powders (referred to herein as "cemented carbide powders"), which may be processed to a final form using, for example, conventional press-and-sinter techniques.

Cemented carbide grades including a discontinuous tungsten carbide phase and a continuous cobalt binder phase exhibit advantageous combinations of ultimate tensile strength, fracture toughness, and wear resistance. As is known in the art, "ultimate tensile strength" is the stress at which a material ruptures or fails. "Fracture toughness" refers to the ability of a material to absorb energy and deform plastically before fracturing. "Toughness" is proportional to the area under the stress-strain curve from the origin to the breaking point. See McGraw-Hill Dictionary of Scientific and Technical Terms ($5^{th}$ ed. 1994). "Wear resistance" refers to the ability of a material to withstand damage to its surface.

Wear generally involves progressive loss of material from an article due to relative motion between the article and a contacting surface or substance. See Metals Handbook Desk Edition (2d ed. 1998). Cemented carbides find extensive use in applications requiring substantial strength and toughness and high wear resistance. Such applications include, for example, metal cutting and metal forming applications, earth-boring and rock cutting applications, and use in machinery wear parts.

The strength, toughness, and wear resistance of a cemented carbide are related to the average size of the regions of dispersed hard phase and the volume (or weight) fraction of the binder phase present in the composite. Generally, increasing the average grain size of the dispersed hard regions and/or the volume fraction of the binder phase in a conventional cemented carbide grade increases the fracture toughness of the composite. However, this increase in toughness is generally accompanied by decreased wear resistance. Metallurgists formulating cemented carbides, therefore, are continually challenged to develop grades exhibiting both high wear resistance and high fracture toughness, and which are otherwise suitable for use in demanding applications.

In many instances, cemented carbide parts are produced as individual articles using conventional powder metallurgy press-and-sinter techniques. The press-and-sinter manufacturing process typically involves pressing or otherwise consolidating a portion of a cemented carbide powder in a mold to provide an unsintered, or "green", compact of defined shape and size. If additional shape features are required in the cemented carbide part that cannot be achieved readily by consolidating the powder, the green compact is machined prior to sintering. This machining step is referred to as "green shaping". If additional compact strength is needed for the green shaping process, the green compact can be presintered before green shaping. Presintering occurs at a temperature lower than the final sintering temperature and provides what is referred to as a "brown" compact. The green shaping operation is followed by the high temperature sintering step. Sintering densifies the material to near theoretical full density to produce a cemented carbide composite. Sintering also develops desired strength and hardness in the composite material.

Rotary cone earth-boring bits and fixed cutter earth-boring bits are employed for oil and natural gas exploration, mining, excavation, and the like. Rotary cone bits typically comprise a steel body onto which cutting inserts, which may be made from cemented carbide or another material, are attached. Referring to FIG. 1, a typical rotary cone bit 10 adapted for earth-boring applications includes a steel body 12 and two or three interlocking rotary cones 13 that are rotatably attached to the body 12. A number of cutting inserts 14 are attached to each rotary cone by, for example, mechanical means, adhesive, or brazing. The cutting inserts, which also may be referred to as "cutting elements", may be made from cemented carbide or another material. FIG. 2 depicts a number of cemented carbide cutting inserts 22 attached to a surface 24 of an insert holder portion of a fixed cutter earth-boring bit.

Conventional cemented carbide cutting inserts configured for use with earth-boring bits are commonly based on pure tungsten carbide (WC) as the dispersed hard phase and pure cobalt (Co) as the continuous binder phase. While WC—Co cemented carbide cutting inserts provide advantages relative to materials previously used in cutting inserts for rotary cone earth-boring bits, WC—Co inserts can suffer from premature abrasion and wear. Premature wear may necessitate replacement of one or more worn cutting inserts or an entire rotary cone or fixed cutter earth-boring bit, which requires removing the drill string from the borehole. This can significantly slow and increase the cost of the drilling process.

Accordingly, it would be advantageous to develop an improved cemented carbide material for use in cutting inserts for rotary cone, fixed cutter, and other earth-boring bits that exhibits advantageous abrasion resistance and wear life compared with conventional WC—Co cemented carbides, while not significantly compromising cutting insert strength and toughness. More generally, it would be advantageous to provide a novel cemented carbide material for uses including those wherein high abrasion resistance and wear life are desired, and wherein strength and toughness also are important.

SUMMARY

One non-limiting aspect of the present disclosure is directed to an earth-boring bit cutting insert comprising a cemented carbide material. In certain non-limiting embodiments according to the present disclosure, the cemented carbide material comprises a plurality of tungsten carbide grains, and a plurality of cubic carbide grains comprising at least one of titanium carbide, vanadium carbide, zirconium carbide, hafnium carbide, niobium carbide, tantalum carbide, and solid solutions thereof. The cemented carbide material includes a binder comprising at least one of cobalt, a cobalt alloy, nickel, a nickel alloy, iron, and an iron alloy.

Another non-limiting aspect of the present disclosure is directed to an earth-boring bit cutting insert comprising a hybrid cemented carbide material. The hybrid cemented carbide material comprises a plurality of first cemented carbide regions comprising tungsten carbide grains and a cobalt binder. The plurality of first cemented carbide regions comprise a dispersed phase. The hybrid cemented carbide material also comprises a second, continuous cemented carbide region comprising second cemented carbide grains in a second region binder. In non-limiting embodiments, the second cemented carbide grains comprise tungsten carbide and at least one of titanium carbide, vanadium carbide, zirconium carbide, hafnium carbide, niobium carbide, tantalum carbide, and solid solutions thereof. The second region binder comprises at least one of cobalt, a cobalt alloy, nickel, a nickel alloy, iron, and an iron alloy. The plurality of first cemented carbide regions are dispersed in the seconded continuous cemented carbide region. The earth-boring bit cutting inserts comprising a hybrid cemented carbide material may be adapted for use on at least one of a rotary cone earth-boring bit and a fixed cutter earth-boring bit.

Yet another non-limiting aspect of the present disclosure is directed to an earth-boring bit. An earth-boring bit according to certain non-limiting embodiments of the present disclosure comprises an earth-boring bit body and at least one earth-boring bit cutting insert. The at least one earth-boring bit cutting insert comprises a cemented carbide material. In certain non-limiting embodiments according to the present disclosure, the cemented carbide material of the at least one cutting insert of the earth-boring bit comprises a plurality of tungsten carbide grains and a plurality of cubic carbide grains. The plurality of cubic grains comprises at least one of titanium carbide, vanadium carbide, zirconium carbide, hafnium carbide, niobium carbide, tantalum carbide, and solid solutions thereof. The cemented carbide material of the at least one earth-boring bit cutting insert includes a binder comprising at least one of cobalt, a cobalt alloy, nickel, a nickel alloy, iron, and an iron alloy.

BRIEF DESCRIPTION OF THE DRAWINGS

The features and advantages of methods and articles of manufacture described herein may be better understood by reference to the accompanying drawings in which.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the materials and articles according to the present disclosure. At the very least, and not as an attempt to limit the application of the doctrine of equivalents to the scope of the claims, each such numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

As used herein, and unless specified otherwise herein, the terms "cemented carbide", "cemented carbide material", and "cemented carbide composite" refer to a sintered material.

While not meant to be limiting, the cemented carbide materials according to the present disclosure may be prepared using conventional techniques for preparing cemented carbide materials. One such conventional technique known as the "press-and-sinter" technique involves pressing a portion of a single or mixture of precursor metallurgical powders to form a green compact, followed by sintering the compact to densify the compact and metallurgically bind the powder particles together. The details of press-and-sinter techniques applied in the production of cemented carbide materials are well known to persons having ordinary skill in the art and, therefore, further description of such details need not be provided herein.

Figure 1:
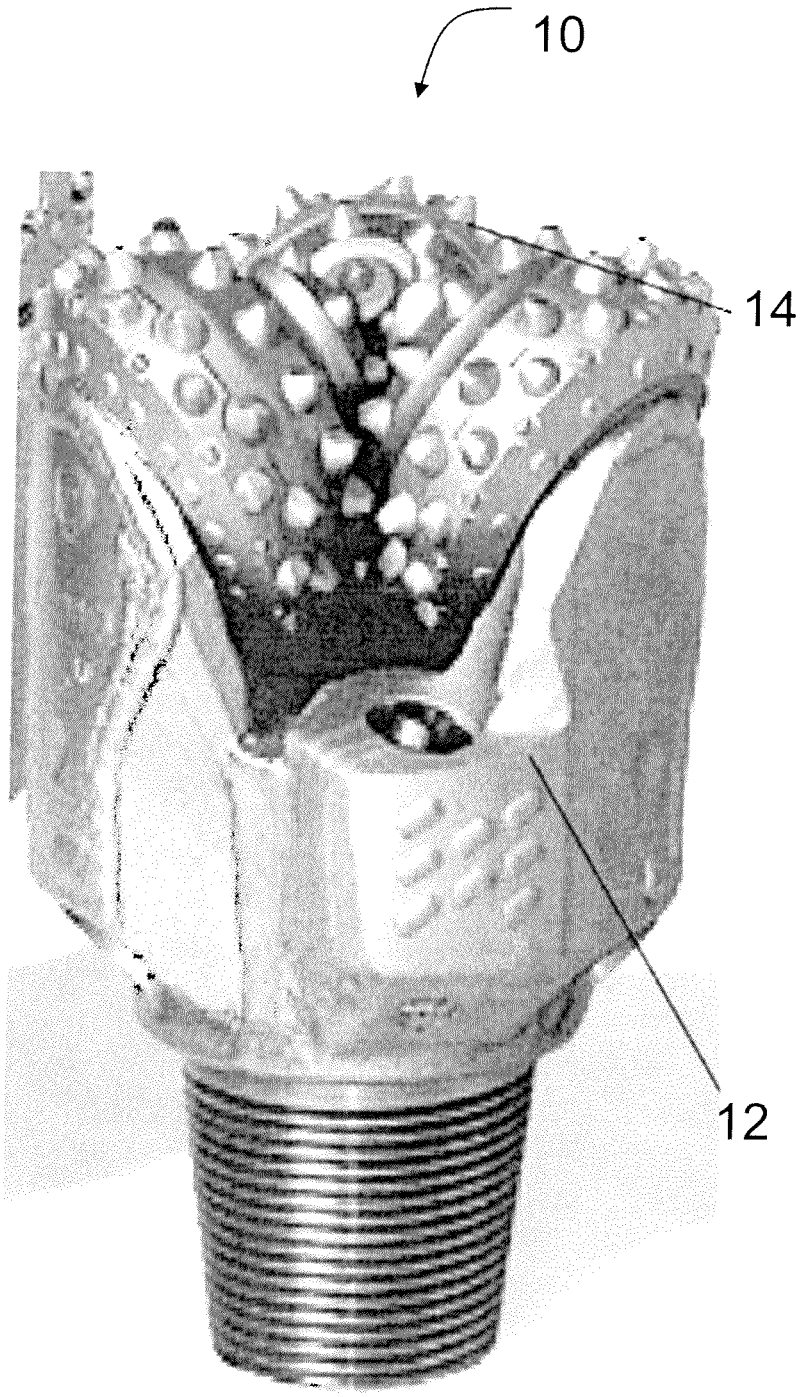
Figure 1 Prior Art
FIG. 1 is a perspective view of a rotary cone earth-boring bit comprising a steel body and conventional WC—Co cemented carbide cutting inserts mounted on the rotary cones.
Figure 2:
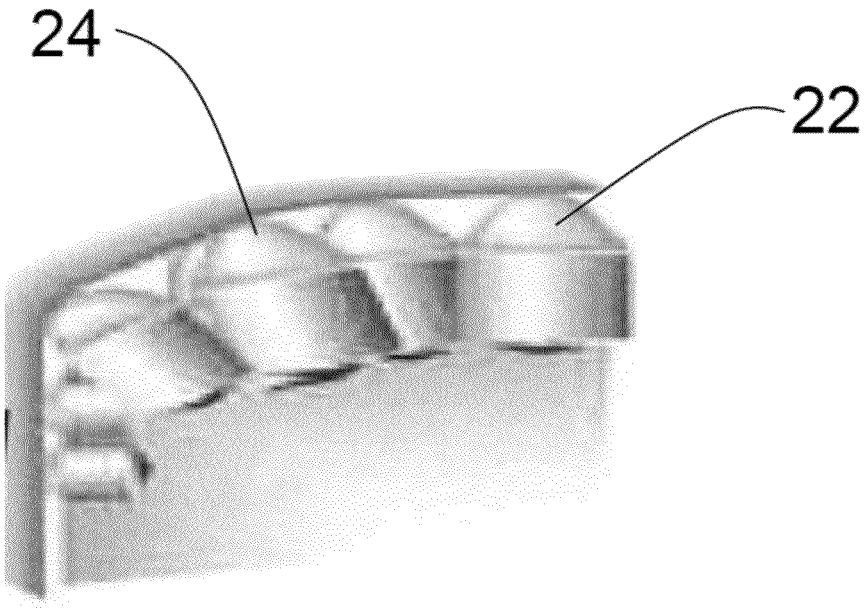
Figure 2 Prior Art
FIG. 2 is a perspective view of a cutting insert holder portion of a fixed cutter earth-boring bit with attached conventional WC—Co cemented carbide cutting inserts.
Figure 3A:
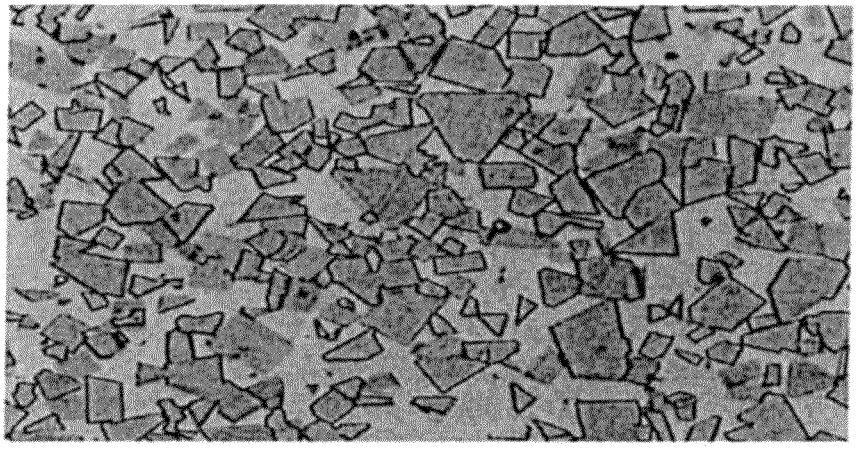
Figure 3A Prior Art
FIG. 3A is a micrograph showing the microstructure of a prior art Grade H-25 cemented carbide material used for earth-boring bit cutting inserts and comprising tungsten carbide hard particles in a cobalt binder.
Figure 3B:
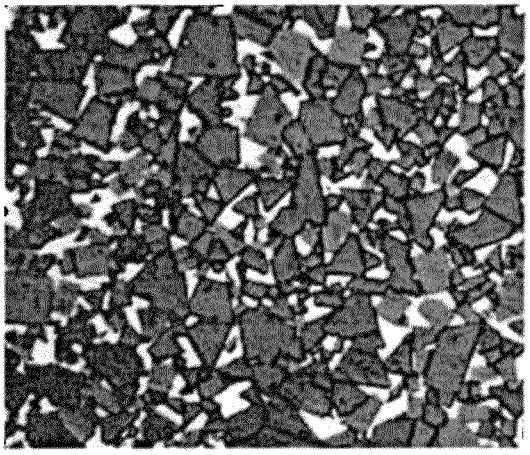
Figure 3B Prior Art
FIG. 3B is a micrograph showing the microstructure of a prior art Grade 231 cemented carbide material used for earth-boring cutting inserts and comprising tungsten carbide hard particles in a cobalt binder.
Figure 3C:
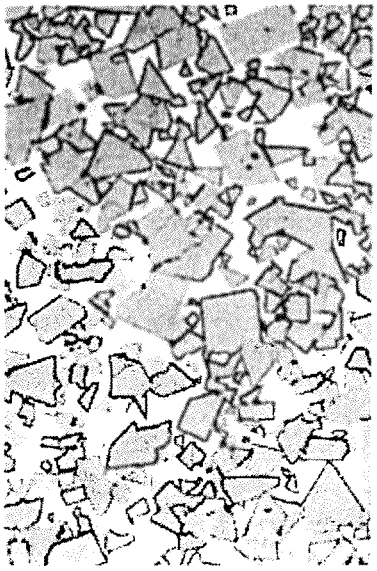
Figure 3C Prior Art
FIG. 3C is a micrograph showing the microstructure of a prior art Grade 45B cemented carbide material used for earth-boring bit cutting inserts and comprising tungsten carbide hard particles in a cobalt binder.

As previously indicated, cemented carbide cutting inserts used with earth-boring bits typically have been based on pure WC as the hard, dispersed, discontinuous phase, and substantially pure Co as the continuous binder phase. WC—Co cutting inserts, however, may suffer from premature abrasion and wear. While not wishing to be held to any particular theory, the present inventors believe that premature wear of WC—Co cutting inserts applied in earth-boring operations results from at least two factors. A first factor is the generally angular morphology of WC grains in the WC—Co material. A second factor is the relative softness of WC, as compared with other transition metal carbides. The photomicrographs of FIGS. 3A through 3C illustrate typical microstructures of WC—Co based cemented carbide materials employed in cutting inserts for earth-boring applications. The WC—Co cemented carbide material shown in FIG. 3A was formed using a press-and-sinter technique from Grade H-25 cemented carbide powder, and includes 75 percent by weight WC particles (also referred to as "grains") having an average grain size of 4 to 6 μm, and 25 percent by weight of cobalt binder. The WC—Co cemented carbide material shown in FIG. 3B was formed using a press-and-sinter technique from Grade 231 cemented carbide powder, and includes 90 percent by weight WC grains having an average grain size of 4 to 6 μm, and 10 percent by weight of cobalt binder. The WC—Co cemented carbide material shown in FIG. 3C was formed using a press-and-sinter technique from Grade 45B cemented carbide powder, and includes 84 percent by weight WC grains having an average grain size of 4 to 6 μm, and 16 percent by weight of cobalt binder. The three grades of WC—Co powder used to make the materials shown in FIGS. 3A-3C are available from ATI Firth Sterling, Madison, Ala. With reference to FIGS. 3A-3C, the WC grains (dark gray regions) exhibit an angular shape, with many of the WC grains including sharp, jagged edges. The present inventors have observed that as WC—Co material wears and abrades and the binder material wears away (as occurs during earth-boring operations), sharp edges of WC grains tend to chip and break readily, leading to premature wear and micro-crack formation in the material.

An aspect of the present disclosure is directed to a cemented carbide material useful for earth-boring bit cutting inserts in which, in a non-limiting embodiment, up to 50% by weight of the cemented carbide material comprises grains of cubic carbides. In another non-limiting embodiment directed to a cemented carbide material useful for earth-boring bit cutting inserts, up to 30% by weight of the cemented carbide material comprises grains of cubic carbides. Cubic carbides used in accordance with non-limiting embodiments of the present disclosure include transition metal carbides from Groups IVB and VB of the Periodic Table of the Elements. These transition metal cubic carbides include titanium carbide, zirconium carbide, hafnium carbide, vanadium carbide, niobium carbide, and tantalum carbide. It has been observed that following pressing and sintering of cemented carbide materials according to the present disclosure, grains of the transition metal cubic carbides and their solid solutions within the material exhibit a relatively rounded grain shape or grain structure. As used herein, the term "grain" refers to individual crystallites of transition metal carbides. As used herein the phrases "angular grains" and "grains with angular features", and variants thereof, refer to grains that possess well-defined edges and sharp corners where the corners form acute through obtuse angles when the material is viewed in a micrograph. As used herein, the phrases "rounded grains", "rounded grain shapes", "rounded grain structures", and variants thereof, refer to grains having smooth edges with a degree of curvature when the material is viewed in a micrograph.

The present inventors have concluded that formulating a cemented carbide material with a significant proportion of transition metal carbide grains having a relatively rounded morphology, rather than an angular morphology, will significantly enhance the wear resistance of the cemented carbide material. The present inventors conclude that such a material will improve the wear resistance characteristics of an earth-boring cutting insert, without significantly compromising other important properties of the earth-boring bit cutting insert.

Figure 4:
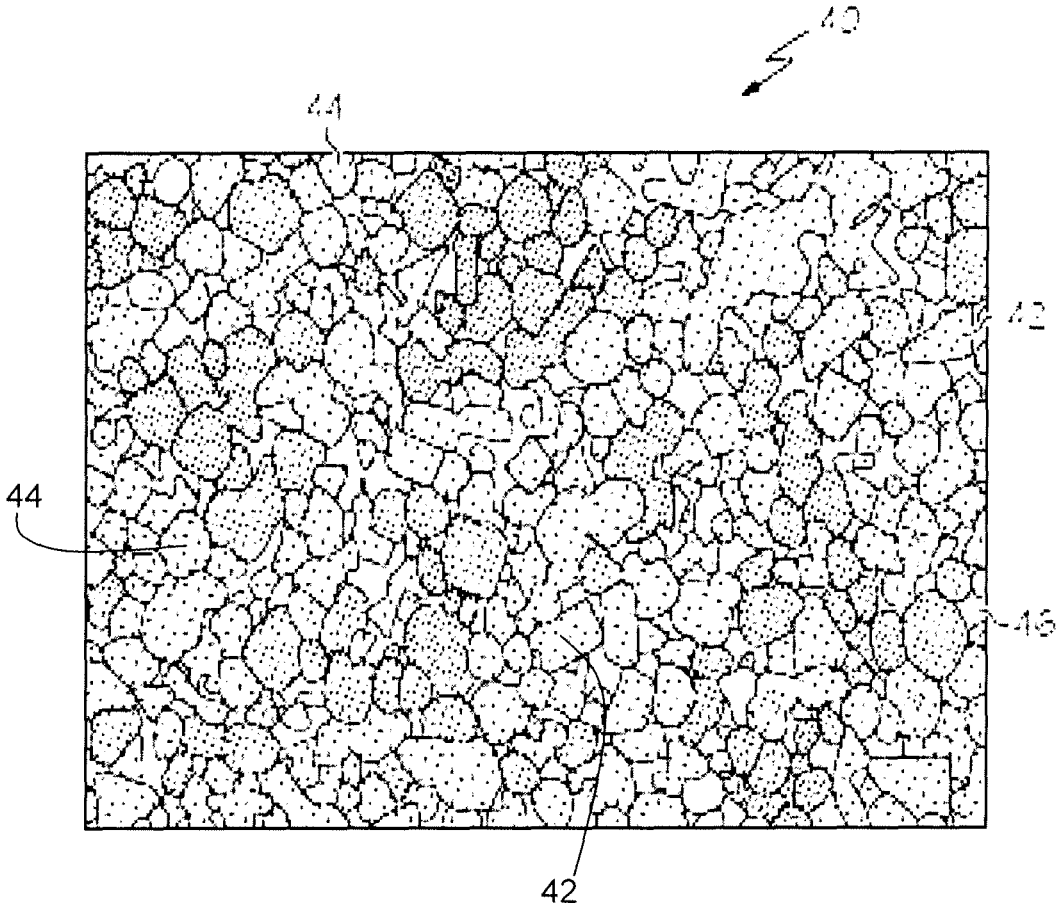
FIG. 4 is a schematic representation of the microstructure of a non-limiting embodiment of a cemented carbide material according to the present disclosure useful for earth-boring cutting inserts and comprising a plurality of tungsten carbide grains, a plurality of cubic carbide grains, and a metallic binder.

Referring now to the schematic representation of FIG. 4, in a non-limiting embodiment according to the present disclosure, a novel cemented carbide material 40 useful for an earth-boring bit cutting insert comprises a plurality of tungsten carbide grains 42. The cemented carbide material 40 further comprises a plurality of cubic carbide grains 44 comprising transition metal cubic carbide. In a non-limiting embodiment, the plurality of cubic carbide grains comprises grains of at least one carbide of a transition metal selected from Group IVB and Group VB of the Periodic Table of the Elements. In another non-limiting embodiment, the plurality of cubic carbide grains comprise at least one of titanium carbide, vanadium carbide, zirconium carbide, hafnium carbide, niobium carbide, tantalum carbide, and solid solutions thereof. In other non-limiting embodiments, the plurality of cubic carbide grains comprise titanium carbide, or tantalum carbide, or niobium carbide, or grains of a solid solution of titanium carbide, tantalum carbide, and niobium carbide. After the step of sintering to produce the cemented carbide material, the cubic carbide grains in the cemented carbide material generally exhibit a more rounded shape than the tungsten carbide grains in the material.

Still referring to FIG. 4, the cemented carbide material for earth-boring bit cutting inserts according to the present disclosure 40 includes a binder 46 (which also may be referred to as a binder phase). In a non-limiting embodiment, the binder 46 comprises at least one of cobalt, a cobalt alloy, nickel, a nickel alloy, iron, and an iron alloy. In another non-limiting embodiment of a cemented carbide material according to the present disclosure, the binder 46 comprises cobalt. In still other non-limiting embodiments, the binder 46 includes at least one additive selected from chromium, ruthenium, rhenium, molybdenum, boron, tungsten, tantalum, titanium, niobium, silicon, aluminum, copper, and manganese. In certain non-limiting embodiments, the binder 46 of the cemented carbide material 40 may include up to a total of 20 weight percent of the additives, based on the total weight of the binder 46. In other non-limiting embodiments, the binder 46 of the cemented carbide material 40 may include a total of up to 15 weight percent, up to 10 weight percent, or up to 5 weight percent of the additives, based on the total weight of the binder 46.

In a non-limiting embodiment of a cemented carbide material according to the present disclosure, the cemented carbide material comprises, in weight percent based on total material weight, 1 to 30% of grains of cubic carbide, 2 to 35% of binder, and the balance being grains of tungsten carbide. In another non-limiting embodiment of a cemented carbide material according to the present disclosure, the cemented carbide material comprises, in weight percent based on total material weight, 1 to 50% of grains of cubic carbide, 2 to 35% of binder, and the balance being grains of tungsten carbide.

Transition metal cubic carbides exhibit a large solubility for one another, and only a slight solubility for tungsten carbide. Therefore, after a step of sintering to produce cemented carbide materials according to the present disclosure, solid solutions of cubic carbides can be formed, which may be referred to as "complex carbides". In various non-limiting embodiments, these complex carbides, or carbide solid solutions, may exhibit a rounded morphology. Tungsten carbide has no solubility for any of the cubic carbides and, therefore, after sintering to produce cemented carbide materials according to the present disclosure, the tungsten carbide grains generally remain as angular grains with sharp corners.

Certain embodiments according to the present invention include earth-boring bit cutting inserts comprising hybrid cemented carbide material (or simply "hybrid cemented carbides"). Whereas a cemented carbide is a composite material typically comprising a discontinuous phase of transition metal carbide dispersed throughout a continuous binder phase, a hybrid cemented carbide comprises at least one discontinuous phase of a cemented carbide grade dispersed throughout a cemented carbide continuous phase, thereby forming a composite of cemented carbides. Hybrid cemented carbides, which are materials well known in the art, are described, for example, in U.S. Pat. No. 7,384,443 ("the U.S. '443 patent"), which is incorporated by reference herein in its entirety.

Figure 5:
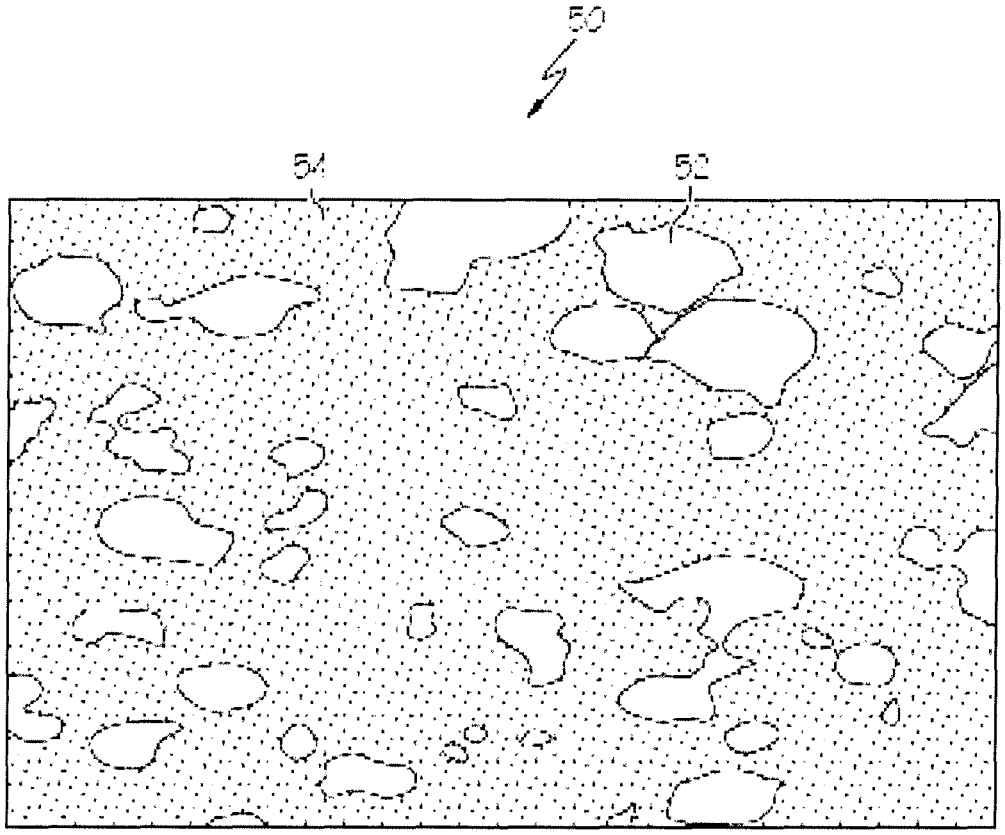
FIG. 5 is a schematic representation of the microstructure of a non-limiting embodiment of hybrid cemented carbide material according to the present disclosure useful for earth-boring cutting inserts.

Referring to the schematic representation shown in FIG. 5, in a non-limiting embodiment of a hybrid cemented carbide 50 according to the present disclosure useful for a cutting insert, each of a plurality of first cemented carbide regions 52 comprises tungsten carbide grains in a first region binder comprising cobalt. The continuous second cemented carbide region 54 comprises second cemented carbide grains in a second region binder. The second cemented carbide grains comprise tungsten carbide grains and grains of at least one of titanium carbide, vanadium carbide, zirconium carbide, hafnium carbide, niobium carbide, tantalum carbide, and solid solutions thereof. The second region binder comprises at least one of cobalt, a cobalt alloy, nickel, a nickel alloy, iron, and an iron alloy. The plurality of first cemented carbide regions 52 are dispersed in the continuous second cemented carbide region 54.

It is recognized that the scope of the present disclosure includes hybrid cemented carbides wherein the compositions of first regions and second regions are reversed from that described above. That is, in a non-limiting embodiment, the first regions of cemented carbide may comprise tungsten carbide together with cubic carbides and a binder comprising at least one of cobalt, a cobalt alloy, nickel, a nickel alloy, iron, and an iron alloy, and the first regions are dispersed in a continuous phase of a second region cemented carbide comprising tungsten carbide grains in a cobalt binder.

Figure 6:
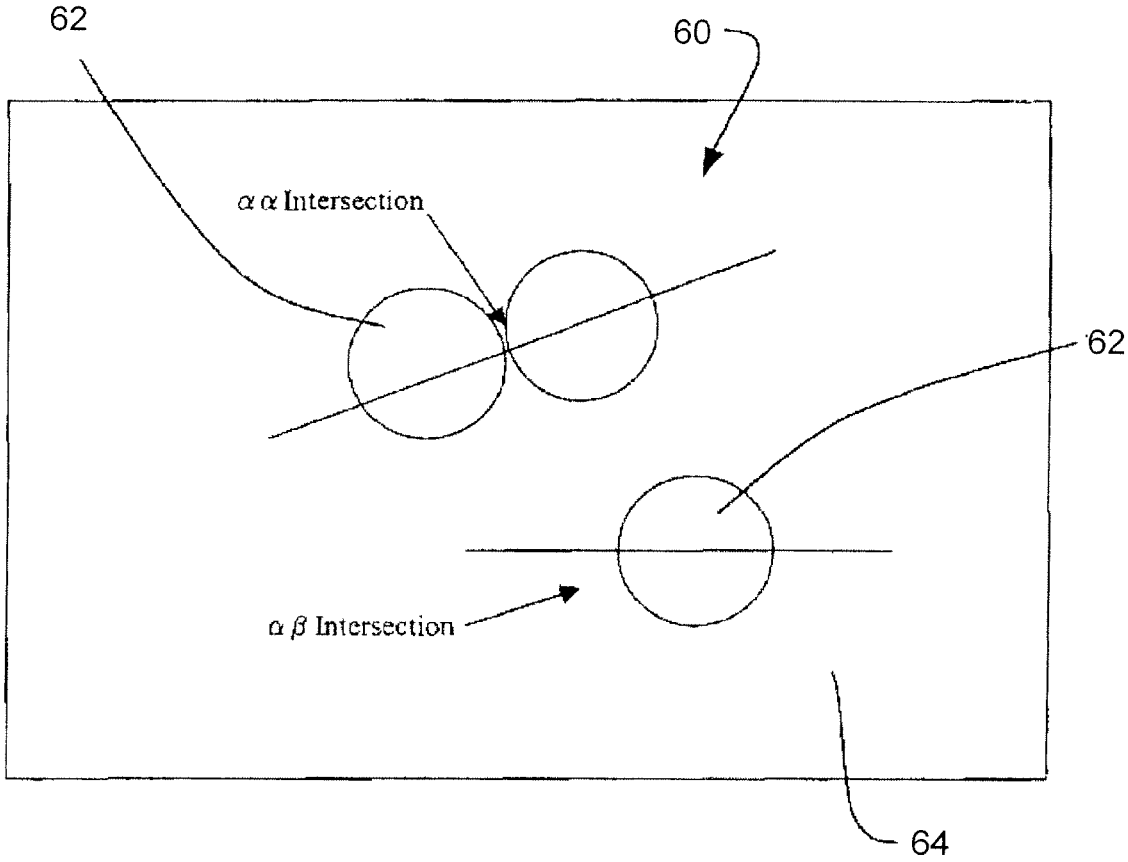
FIG. 6 is a graphical depiction of a step in a method for determining the contiguity ratio of a composite material, such as a cemented carbide material, comprising a dispersed phase and a continuous matrix phase.

Certain embodiments of the method for producing hybrid cemented carbides according to the U.S. '443 patent provide for the formation of such materials wherein the dispersed cemented carbide phase has a relatively low contiguity ratio. The degree of dispersed phase contiguity in a composite structure may be characterized as the contiguity ratio, $C_t$. As is known to those having ordinary skill, $C_t$ may be determined using a quantitative metallography technique described in Gurland, "Application of Quantitative Microscopy to Cemented Carbides", *Practical Applications of Quantitative Metalloaraphy*, ASTM STP 839, J. L. McCall and J. H. Steale, Jr., Eds., American Society for Testing and Materials, Philadelphia (1984) pp. 65-83, hereby incorporated by reference. The technique consists of determining the number of intersections that randomly oriented lines of known length, placed on the microstructure as a photomicrograph of the material, make with specific structural features. The total number of intersections in the photomicrograph made by the lines with dispersed phase/dispersed phase intersections are counted and are referred to as $N_L\alpha\alpha$. The total number of intersections in the photomicrograph made by the lines with dispersed phase/continuous phase interfaces also are counted and are referred to as $N_L\alpha\beta$. FIG. 6 schematically illustrates the procedure by which the values for $N_L\alpha\alpha$ and $N_L\alpha\beta$ are obtained. In FIG. 6, 60 generally designates a composite including the dispersed phase 62 of a phase in a continuous phase 64 of β phase. The contiguity ratio $C_t$ is calculated by the equation $C_t=2\ N_L\alpha\alpha/(N_L\alpha\beta+2\ N_L\alpha\alpha)$. The method described in Gurland is extended to measuring the contiguity ratio of hybrid cemented carbide composites in the U.S. '443 patent, for example.

The contiguity ratio is a measure of the average fraction of the surface area of dispersed phase regions in contact with other dispersed first phase regions, i.e., contiguous dispersed phase regions. The ratio may vary from 0 to 1 as the distribution of the dispersed regions changes from completely dispersed to a fully agglomerated structure. The contiguity ratio describes the degree of continuity of dispersed phase irrespective of the volume fraction or size of the dispersed phase regions. However, typically, for higher volume fractions of the dispersed phase, the contiguity ratio of the dispersed phase will also likely be relatively high.

In the case of hybrid cemented carbides, when the dispersed phase of cemented carbide has a higher hardness than the continuous phase of cemented carbide, lower contiguity ratios for the cemented carbide dispersed phase reflect a smaller likelihood that a crack will propagate through any contiguous dispersed phase regions. This cracking process may be a repetitive one, with cumulative effects resulting in a reduction in the overall toughness of the hybrid cemented carbide article, which may be present in, for example, a cutting insert for an earth-boring bit. As mentioned above, replacing a cutting insert or an entire earth-boring bit may be both time-consuming and costly.

In certain embodiments, hybrid cemented carbides according to the present disclosure may comprise between about 2 to about 40 vol. % of the cemented carbide grade of the first region or dispersed phase. In other embodiments, the hybrid cemented carbides may comprise between about 2 to about 30 vol. % of the cemented carbide grade of the second region or continuous phase. In still further applications, it may be desirable to include between 6 and 25 volume % of the cemented carbide of the first region or dispersed phase in the hybrid cemented carbide.

The U.S. '443 patent discloses a method of producing hybrid cemented carbides with improved properties. As is known to those having ordinary skill, the method of producing a hybrid cemented carbide typically includes blending at least one of partially and fully sintered granules of the dispersed cemented carbide grade (i.e., the first region cemented carbide) with at least one of green and unsintered granules of the continuous cemented carbide grade (i.e., the second region cemented carbide). The blend is then consolidated, and subsequently is sintered using conventional means. Partial or full sintering of the granules of the dispersed phase results in strengthening of the granules (as compared to "green" granules). In turn, the strengthened granules of the dispersed phase will have an increased resistance to collapse during the step of consolidating the blend. The granules of the dispersed phase may be partially or fully sintered at temperatures ranging from about 400° C. to about 1300° C., depending on the desired strength of the dispersed phase. The granules may be sintered by a variety of means, such as, but not limited to, hydrogen sintering and vacuum sintering. Sintering of the granules may remove lubricant, reduce oxides, and densify and develop the microstructure of the granules. Partially or fully sintering the dispersed phase granules prior to blending results in a reduction in the collapse of the dispersed phase during consolidation.

In addition to shape differences between WC grains and grains of other transition metal carbides such as, for example, titanium carbide (TiC), tantalum carbide (TaC), niobium carbide (NbC), zirconium carbide (ZrC), hafnium carbide (HfC), and vanadium carbide (VC), there are significant differences in the melting points and microhardness of the different carbides, as shown in Table 1.

TABLE 1

| Transition Metal Carbide | Melting Point (° C.) | Microhardness (kg/mm$^2$) |
|---|---|---|
| TiC | 3,250 | 3,200 |
| ZrC | 3,175 | 2,600 |
| HfC | 3,900 | 3,400 |
| VC | 2,830 | 2,800 |
| NbC | 3,500 | 2,400 |
| WC | 2,630 | 2,300 |

As is observed in Table 1, TiC, TaC, NbC, ZrC, HfC, and VC have significantly higher melting points than WC, and are harder than WC. The present inventors believe that based on the higher hardness and more rounded morphology of grains of carbides of titanium, tantalum, niobium, zirconium, hafnium, and vanadium compared to tungsten carbide, the overall wear resistance of cemented carbide materials and articles, such as cutting inserts for earth-boring bits, according to the present disclosure will be significantly greater than for materials and articles, such as earth-boring bit cutting inserts, made from cemented carbide consisting of WC and Co. The improvement in wear resistance should result in an increase in service life for earth-boring bits including cutting inserts made from cemented carbide materials according to the present disclosure.

The addition of TiC to cemented carbide materials in certain embodiments according to the present disclosure will improve corrosion resistance, which, in turn, will help to avoid premature wear failures resulting from corrosion. The addition of TaC to cemented carbide materials in certain embodiments according to the present disclosure will improve elevated-temperature hardness as well as resistance to micro-crack formation during thermal cycling, which is a common failure mode in cemented carbide inserts employed in earth-boring applications.

Figure 7:
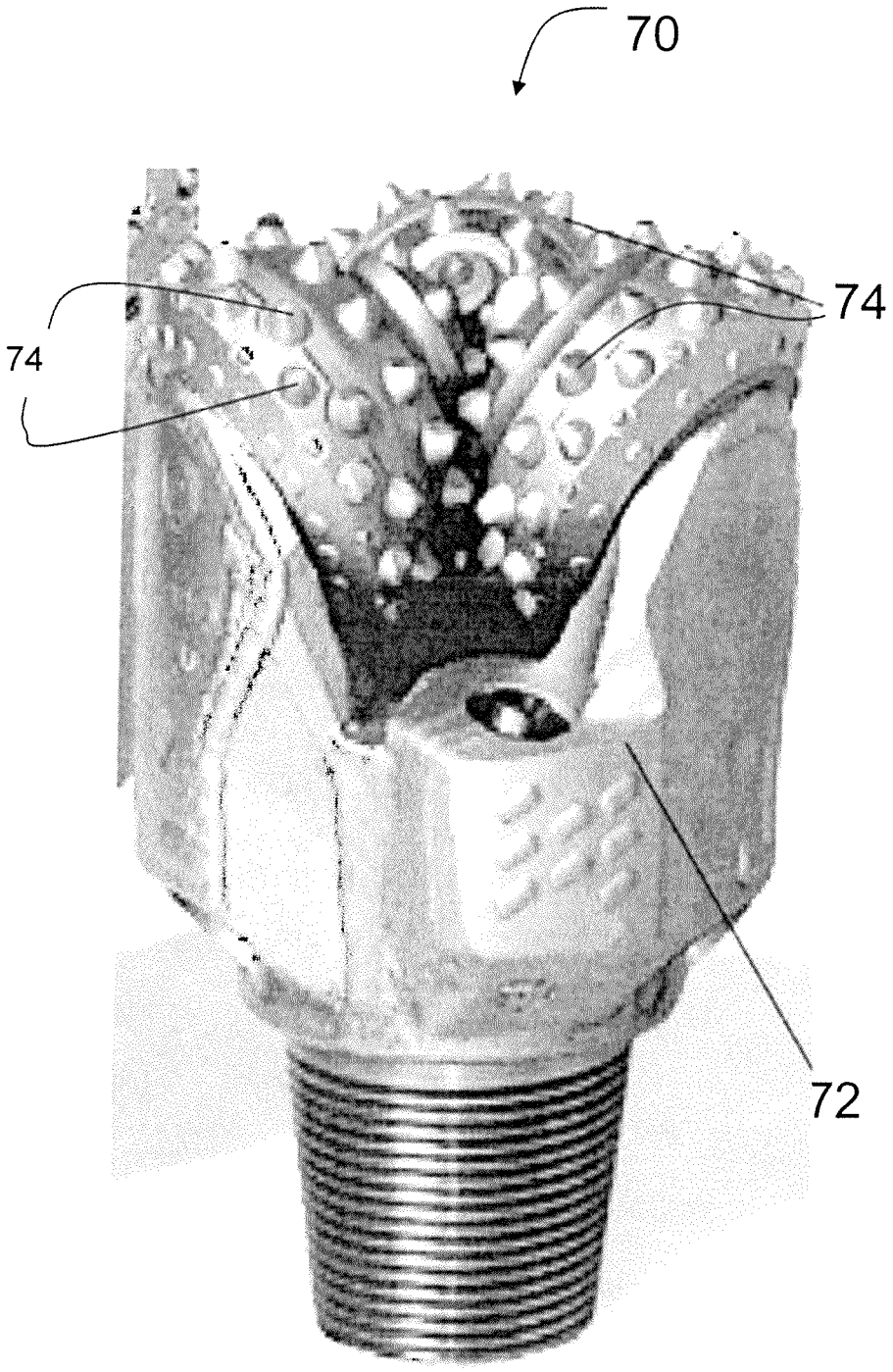
FIG. 7 is a schematic representation of a rotary cone earth-boring bit according to the present disclosure, including a plurality of cutting inserts comprising cubic carbides.

Another aspect according to the present disclosure is directed to an article of manufacture wherein at least a portion of the article comprises or consists of one or more of the cemented carbide materials according to the present disclosure. The articles of manufacture include, but are not limited to, cutting inserts for earth-boring bits. Cutting inserts according the present disclosure include, for example, cutting inserts for rotary cone earth-boring bits, fixed cutter earth-boring bits, and other earth-boring bits. FIG. 7 is a schematic representation of a rotary cone earth-boring bit 70 according to the present disclosure. A rotary cone earth-boring bit 70 according to a non-limiting embodiment comprises a conventional earth-boring bit body 72 that includes a plurality of cutting inserts 74 fabricated according to embodiments of the present disclosure.

In addition, the advantageous combination of strength, fracture toughness, and abrasion/wear resistance of cemented carbide materials according to the present disclosure make the cemented carbide materials attractive for use on blade portions, cutting insert holder portions, and blade support portions of fixed cutter earth-boring bits. It also is believed that embodiments of cemented carbide materials according to the present disclosure can be used in cutting inserts and cutting tools for machining metals and metallic alloys, such as, but not limited to, titanium alloys, nickel-based superalloys, and other difficult-to-machine metallic alloys.

EXAMPLE 1

Figure 8:
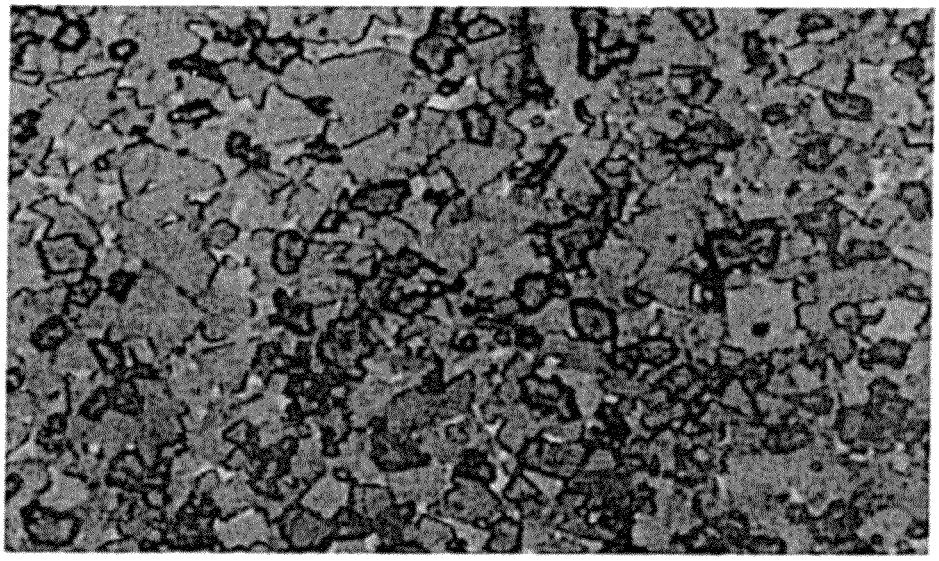
FIG. 8 is a micrograph of a non-limiting embodiment of a cemented carbide material according to the present disclosure useful for earth-boring cutting inserts and comprising cubic carbides grains consisting of a solid solution of titanium carbide, tantalum carbide, and niobium carbide.

The microstructure of a non-limiting embodiment of a sintered cemented carbide material according to the present disclosure is shown in the photomicrograph of FIG. 8. The cemented carbide material shown in FIG. 8 was prepared by forming a powder blend consisting of, in percent by weight, 75% WC powder, 8% TiC powder, 5% TaC powder, 5% NbC powder, and 7% Co powder. The blended powder was consolidated into a green compact. The green compact was sintered at 1420° C.

The cemented carbide shown in the micrograph of FIG. 8 exhibits grains of tungsten carbide, and rounded grains comprising titanium carbide, tantalum carbide, niobium carbide, and their solid solutions. It is anticipated that the presence of the rounded grains comprising cubic carbides will improve the wear resistance of cutting inserts for earth-boring bits, while not substantially affecting certain other important properties of the cutting inserts, thereby extending the service life of the cutting inserts.

EXAMPLE 2

Figure 9:
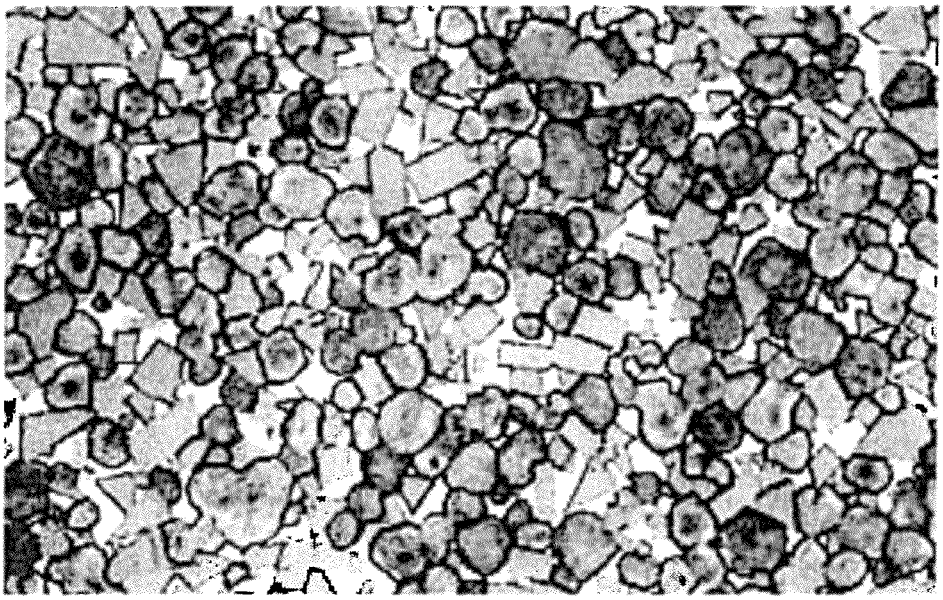
FIG. 9 is a micrograph of a non-limiting embodiment of a cemented carbide material according to the present disclosure useful for earth-boring cutting inserts and comprising cubic carbides grains consisting of a solid solution of tantalum carbide and niobium carbide.

The microstructure of a non-limiting embodiment of a sintered cemented carbide material according to the present disclosure is shown in the photomicrograph of FIG. 9. The cemented carbide material shown in FIG. 9 was prepared by forming a powder blend consisting of, in percent by weight, 50% WC powder, 22% TaC powder, 20% NbC powder and 8% Co powder. The blended powder was consolidated into a green compact. The green compact was sintered at 1420° C.

The cemented carbide in the micrograph of FIG. 9 exhibits grains of tungsten carbide, and rounded grains comprising tantalum carbide, niobium carbide, and their solid solutions. It is anticipated that the presence of the rounded grains comprising cubic carbides will improve the wear resistance of cutting inserts for earth-boring bits, while not substantially affecting certain other important properties of the cutting inserts, thereby extending the service life of the cutting inserts.

EXAMPLE 3

Figure 10:
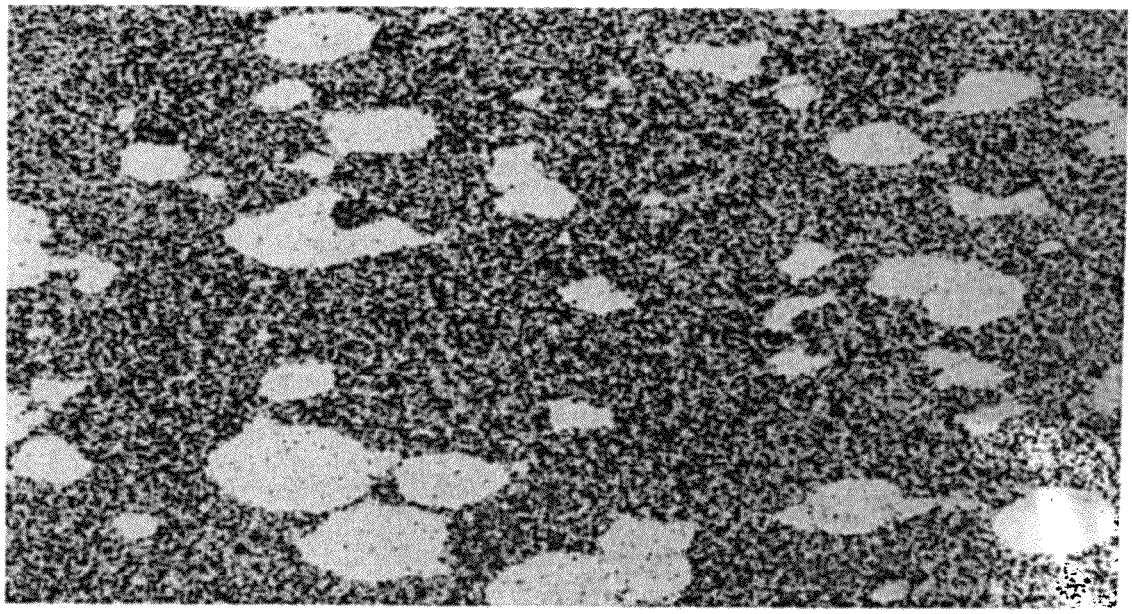
FIG. 10 is a micrograph of a non-limiting embodiment of a hybrid cemented carbide material according to the present disclosure useful for earth-boring cutting inserts.

The microstructure of a non-limiting embodiment of a sintered hybrid cemented carbide material according to the present disclosure is shown in the photomicrograph of FIG. 10. Two separate metallurgical powder blends were prepared. The first metallurgical powder blend, used for the continuous, second cemented carbide region, was prepared by forming a powder blend consisting of, in percent by weight, 50% WC powder, 22% TaC powder, 20% NbC powder, and 8% Co powder. A second metallurgical powder blend to be used for the plurality of first cemented carbide regions, or dispersed phase, was prepared by blending, in percent by weight, 90% of WC powder and 10% of Co powder. In percent by weight, 85% of the first metallurgical powder blend was mixed with 15% of the second metallurgical powder blend. The mixed powder was consolidated and sintered at 1420° C. to form a sintered hybrid cemented carbide material.

In the non-limiting embodiment of FIG. 10, a hybrid cemented carbide material comprises a plurality of first cemented carbide regions (the lighter colored regions in the photomicrograph of FIG. 10) comprising tungsten carbide grains in a binder phase comprising cobalt, dispersed in a continuous second region (the darker region in the photomicrograph of FIG. 10) of a second cemented carbide comprising tungsten carbide grains and also grains of titanium carbide, tantalum carbide, niobium carbide, and their solid solutions. It is anticipated that the presence of the cubic carbides will improve the wear resistance of cutting inserts for earth-boring bits, while not substantially affecting certain other important properties of the cutting inserts, thereby extending the service life of the cutting inserts.

EXAMPLE 4

A study was conducted to assess the effectiveness of cubic carbide addition to increase abrasion resistance of cemented carbides. The following cemented carbide materials having the indicated compositions were prepared from metallurgical powders using conventional press-and-sinter techniques:

Alloy A: Cemented carbide consisting of 10 weight percent cobalt and balance tungsten carbide. The material included a discontinuous phase of tungsten carbide in a continuous phase of cobalt. The grain size of the tungsten carbide was about 5 μm.

Alloy B: Cemented carbide consisting of 10.55 weight percent cobalt, 2.5 weight percent titanium carbide, 2.5 weight percent tantalum carbide, and balance tungsten carbide. The material included a discontinuous phase including grains of titanium carbide and tantalum carbide (both cubic carbides) and grains of tungsten carbide, in a continuous phase of cobalt. As in Alloy A, the tungsten carbide grain size was about 5 μm. The cobalt content in Alloy B was higher than in Alloy A to compensate for the change in the total volume fraction of the hard phases and thereby maintain a constant volume fraction of the binder (cobalt). Thus, Alloy B differs from Alloy A in the addition of cubic carbides.

Alloy C: Cemented carbide consisting of 10.75 weight percent cobalt, 5 weight percent titanium carbide, 5 weight percent tantalum carbide, and balance tungsten carbide. The material included a discontinuous phase including grains of titanium carbide, tantalum carbide, and tungsten carbide, in a continuous phase of cobalt. The tungsten carbide grain size remained the same (about 5 μm) as in Alloys A and B, and the cobalt content was selected to maintain a constant volume fraction of the binder relative to Alloys A and B. Alloy C differs from Alloy B in that it includes a higher volume fraction of cubic carbides.

Alloy D: Cemented carbide consisting of 11.1 weight percent cobalt, 10 weight percent titanium carbide, 10 weight percent tantalum carbide, and balance tungsten carbide. The material included a discontinuous phase including grains of titanium carbide, tantalum carbide, and tungsten carbide, in a continuous phase of cobalt. The tungsten carbide grain size remained the same (about 5 μm) as in Alloys A-C, and the cobalt content was selected to maintain a constant volume fraction of the binder relative to Alloys A-C. This alloy is similar to alloy C but contains a higher cubic carbide content.

Alloy E: Cemented carbide consisting of 10.55 weight percent cobalt, 5 weight percent tantalum carbide, and balance tungsten carbide. The material included a discontinuous phase including grains of tantalum carbide and grains of tungsten carbide, in a continuous phase of cobalt. The tungsten carbide grain size remained the same (about 5 μm) as in Alloys A-D. Alloy E is similar to Alloy B but all cubic carbide is present as tantalum carbide.

Alloy F: Cemented carbide consisting of 10.75 weight percent cobalt, 10 weight percent tantalum carbide, and balance tungsten carbide. The material included a discontinuous phase including grains of tantalum carbide and grains of tungsten carbide, in a continuous phase of cobalt. The tungsten carbide grain size remained the same (about 5 μm) as in Alloys A-E. Alloy F is similar to Alloy C but all cubic carbide is present as tantalum carbide.

Figure 11:
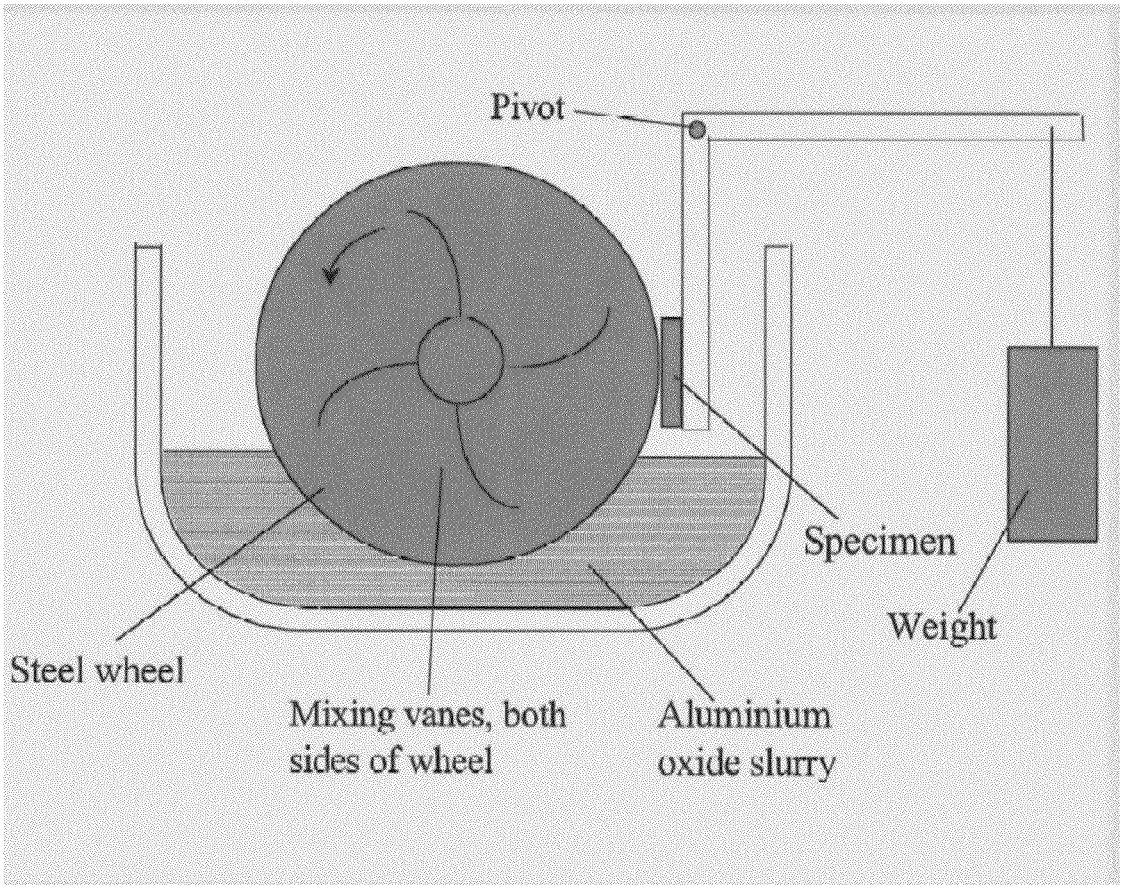
FIG. 11 is a schematic representation of an apparatus employed for measuring the wear resistance of cemented carbides according to ASTM B611 used in Example 4 of the following disclosure.

The abrasion resistance of each of each of Alloys A-F was measured using the procedure described in ASTM B611-85 (2005) ("Standard Test Method for Abrasive Resistance of Cemented Carbides"). The test apparatus used in the wear resistance testing is shown schematically in FIG. 11. The test consisted of abrading a specimen of the test material using an aluminum oxide particle slurry. The slurry was abraded against a surface of the test specimen by a rotating steel wheel partially disposed in a bath of the slurry. As indicated in FIG. 11, the specimen was urged against the peripheral surface of the rotating wheel (and the slurry on that surface) using a weight and a pivot arrangement. The wheel included mixing vanes on both sides thereof to agitate the slurry during wheel rotation. The volume loss ($cm^3$) experienced by the test specimen per revolution of the steel wheel was recorded, and the abrasion wear resistance of the specimen was reported as a "wear number" having units of krevs/$cm^3$. Materials having a higher wear number are more resistant to abrasive wear than materials having a lower wear number as it requires a greater number of wheel revolutions on the testing equipment to abrade a unit volume of material.

Figure 12:
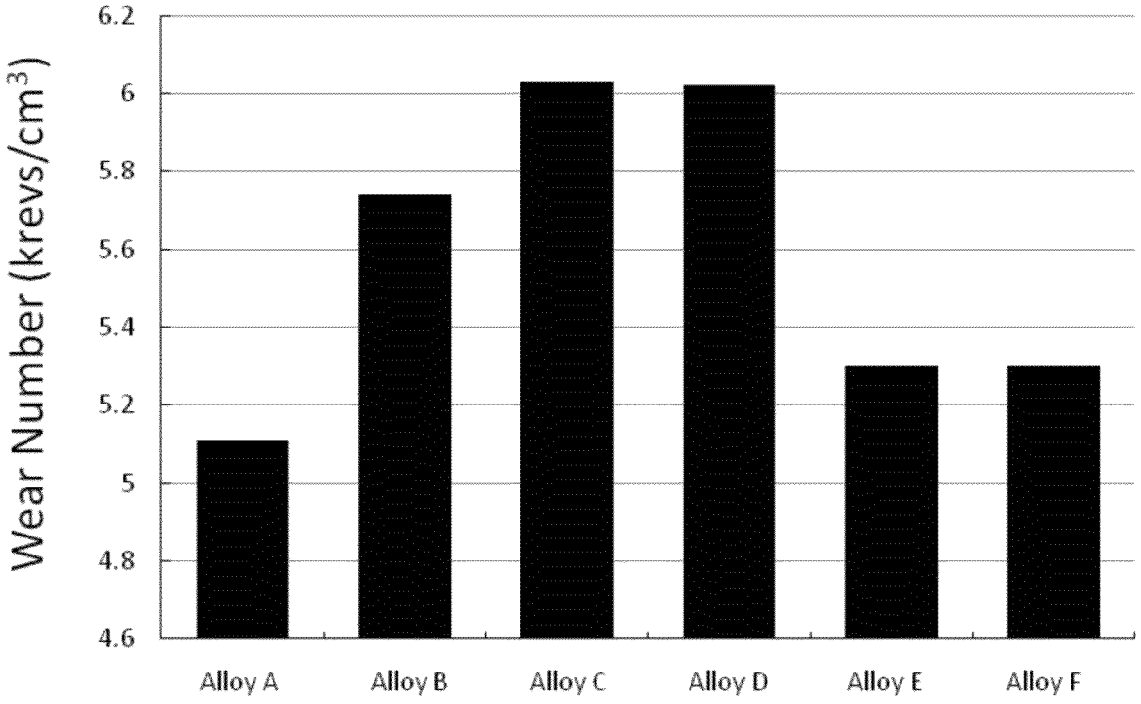
FIG. 12 is graph plotting wear number for several cemented carbide materials evaluated for wear resistance in Example 4 of the following disclosure.

The wear resistance number determined for each of Alloys A-F using the method of ASTM B611 is plotted in the graph in FIG. 12. Test results clearly show that the wear number, and thus the abrasion wear resistance, increased significantly with increasing cubic carbide content. As noted, the cobalt content of each of the alloys was adjusted so that each included approximately the same volume content of binder (cobalt). Nevertheless, Alloy B, including a total of 5 weight percent cubic carbides, was measured to have a wear number of about 5.75, while Alloy A, which lacked cubic carbides, was measured to have a wear number of only 5.1. Alloys C and D, which each had a cubic carbide content of 10 weight percent, were measured to have wear numbers in excess of 6, substantially greater than the wear numbers determined for Alloy A (lacking cubic carbides) and Alloy B (including half the weight percentage of cubic carbide). Alloys E and F, which included cubic carbide only in the form of tantalum carbide, also were measured to have a wear number (5.3) that is significantly greater than the wear number of Alloy A.

The fracture toughness of each of Alloys A-F was measured using the method described in ASTM B771-11e1 ("Standard Test Method for Short Rod Fracture Toughness of Cemented Carbides"). The fracture resistance property determined by this test method is believed to characterize the resistance of a cemented carbide to fracture in a neutral environment in the presence of a sharp crack under severe tensile constraint, such that the state of stress near the crack front approaches tri-tensile plane strain, and the crack-tip plastic region is small compared with the crack size and specimen dimensions in the constraint direction. The results of the testing are presented in Table 2 below.

TABLE 2

| Material | Fracture Toughness (ksi · √in) |
|---|---|
| Alloy A | 13.6 |
| Alloy B | 12.3 |
| Alloy C | 11.7 |
| Alloy D | 10.5 |
| Alloy E | 12.6 |
| Alloy F | 12.5 |

The results in Table 2 show that the significant improvements in wear resistance provided by the addition of cubic carbides are accompanied by the loss of some fracture toughness. However, the improvements in wear resistance achieved by the materials including cubic carbides are believed to outweigh the loss in fracture toughness in many applications of cemented carbides including, for example, most rock drilling applications in the oil, gas, and mining fields.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A cutting insert for an earth-boring bit, the cutting insert including a hybrid cemented carbide material comprising:

a plurality of first cemented carbide regions comprising tungsten carbide grains in a first region binder comprising cobalt;

wherein the plurality of first cemented carbide regions comprise a dispersed phase; and a second continuous cemented carbide region comprising second cemented carbide grains in a second region binder;

wherein the second cemented carbide grains comprise tungsten carbide and at least one of titanium carbide, vanadium carbide, zirconium carbide, hafnium carbide, niobium carbide, tantalum carbide, and solid solutions thereof; and wherein the second region binder comprises at least one of cobalt, a cobalt alloy, nickel, a nickel alloy, iron, and an iron alloy; and wherein the plurality of first cemented carbide regions are dispersed in the second continuous cemented carbide region.

2. The cutting insert of claim 1, wherein each of the second cemented carbide regions comprises, in percent by weight: from 1 to 50% of the cubic carbide grains; from 2 to 35% of the binder; and the balance of the tungsten carbide grains.

3. The cutting insert of claim 1 adapted for use on at least one of a rotary cone earth-boring bit and a fixed cutter earth-boring bit.

* * * * *